US012655977B1

(12) United States Patent
Badhuk et al.

(10) Patent No.: US 12,655,977 B1
(45) Date of Patent: Jun. 16, 2026

(54) FUEL INJECTOR ARCHITECTURES FOR TURBINE ENGINES WITH MULTI-STAGE GEOMETRY, STAGED FUEL INJECTION, AND HYBRID SWIRL CONTROL

(71) Applicant: GENERAL ELECTRIC COMPANY, Evendale, OH (US)

(72) Inventors: Pabitra Badhuk, Jhargram (IN); Aritra Chakraborty, Kolkata (IN); Prithiviraaj Pet T, Madurai (IN); Karthikeyan Sampath, Bengaluru (IN); Pradeep Naik, Bengaluru (IN); Perumallu Vukanti, Bengaluru (IN); Michael T. Bucaro, Arvada, CO (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/978,123

(22) Filed: Dec. 12, 2024

(51) Int. Cl.

| | |
|---|---|
| ***F23R 3/14*** | (2006.01) |
| ***F23R 3/28*** | (2006.01) |
| *F23R 3/00* | (2006.01) |

(52) U.S. Cl.
CPC ..... *F23R 3/14* (2013.01); *F23R 3/286* (2013.01); *F23R 3/002* (2013.01)

(58) Field of Classification Search
CPC ..... F23R 3/14; F23R 3/286
See application file for complete search history.

(56) References Cited

U.S. PATENT DOCUMENTS

| | | | | |
|---|---|---|---|---|
| 5,778,676 | A * | 7/1998 | Joshi | F23D 17/002 60/737 |
| 6,684,640 | B2 | 2/2004 | McMillan et al. | |
| 9,126,210 | B1 | 9/2015 | Acharya | |
| 10,969,107 | B2 | 4/2021 | Rickey et al. | |
| 11,378,277 | B2 | 7/2022 | Joshi et al. | |
| 11,454,396 | B1 | 9/2022 | Boardman et al. | |
| 11,920,792 | B1 * | 3/2024 | Boardman | F23R 3/286 |

(Continued)

FOREIGN PATENT DOCUMENTS

| | | |
|---|---|---|
| CN | 110285447 A | 9/2019 |
| CN | 114877373 A | 8/2022 |

(Continued)

OTHER PUBLICATIONS

Extended European Search Report for Application No. 25216749.9 dated Apr. 1, 2026, 9 pages.

*Primary Examiner* — William H Rodriguez
(74) *Attorney, Agent, or Firm* — Carter, DeLuca & Farrell, LLP

(57) ABSTRACT

A fuel injector is provided for a turbine engine comprising a compression section, a combustion section, and a turbine section is serial flow arrangement. The fuel injector includes an outer wall surrounding an injector passage and defining a longitudinal injector axis. The injector passage exhausts at an injector outlet and defines a flow direction through the injector passage. A first converging portion is provided in the outer wall. A swirler assembly configured to provide a swirled airflow to the injector passage upstream of the first converging portion relative to the flow direction. A first set of fuel passages are provided in annular arrangement about the outer wall fluidly exhausting to the injector passage downstream of the first converging portion relative to the flow direction.

19 Claims, 15 Drawing Sheets

(56) References Cited

U.S. PATENT DOCUMENTS

| | | | | |
|---|---|---|---|---|
| 12,007,117 | B1 * | 6/2024 | Boardman | F02C 7/22 |
| 2004/0035386 | A1 * | 2/2004 | Sanders | F23R 3/32 123/305 |
| 2010/0050644 | A1 * | 3/2010 | Pidcock | F23R 3/343 60/737 |
| 2016/0169160 | A1 * | 6/2016 | Okada | F02M 9/00 60/737 |
| 2019/0107053 | A1 | 4/2019 | Miyamoto et al. | |
| 2019/0170354 | A1 * | 6/2019 | Resvanis | F23R 3/16 |
| 2020/0025386 | A1 * | 1/2020 | Muldal | F23R 3/343 |
| 2020/0325831 | A1 * | 10/2020 | Tsunoda | F02C 9/00 |
| 2021/0010674 | A1 * | 1/2021 | Thariyan | F23R 3/14 |
| 2021/0207808 | A1 * | 7/2021 | Mishra | F23R 3/286 |
| 2023/0194091 | A1 * | 6/2023 | Vukanti | F23R 3/14 60/737 |
| 2023/0272911 | A1 | 8/2023 | Chon | |
| 2023/0366551 | A1 * | 11/2023 | Vukanti | F23D 14/24 |
| 2024/0110520 | A1 | 4/2024 | Dudebout | |
| 2024/0183537 | A1 * | 6/2024 | Kasuga | F23D 11/383 |
| 2025/0224115 | A1 * | 7/2025 | Naik | F23R 3/346 |
| 2025/0251133 | A1 * | 8/2025 | Naik | F23R 3/286 |

FOREIGN PATENT DOCUMENTS

| | | | |
|---|---|---|---|
| EP | 3301374 | A1 | 4/2018 |
| EP | 3406974 | A1 | 11/2018 |
| EP | 4664010 | A1 | 12/2025 |

* cited by examiner

FUEL INJECTOR ARCHITECTURES FOR TURBINE ENGINES WITH MULTI-STAGE GEOMETRY, STAGED FUEL INJECTION, AND HYBRID SWIRL CONTROL

TECHNICAL FIELD

The present subject matter relates generally to a fuel injector for supplying a mixture of fuel and air to a turbine engine, and more specifically, for supplying the mixture of fuel and air to a combustor for combustion to drive the turbine engine.

BACKGROUND

A turbine engine typically includes a fan and a turbomachine. The turbomachine generally includes an inlet, one or more compressors, a combustor, and at least one turbine. The compressors compress air which is channeled to the combustor where it is mixed with fuel. The mixture is then ignited for generating hot combustion gases. The combustion gases are channeled to the turbine(s) which extracts energy from the combustion gases for powering the compressor(s), as well as for producing useful work to propel an aircraft in flight or to power a load, such as an electrical generator.

BRIEF DESCRIPTION OF THE DRAWINGS

A full and enabling disclosure, including the best mode thereof, directed to one of ordinary skill in the art, is set forth in the specification, which makes reference to the appended figures, in which.

DETAILED DESCRIPTION

Figure 1:
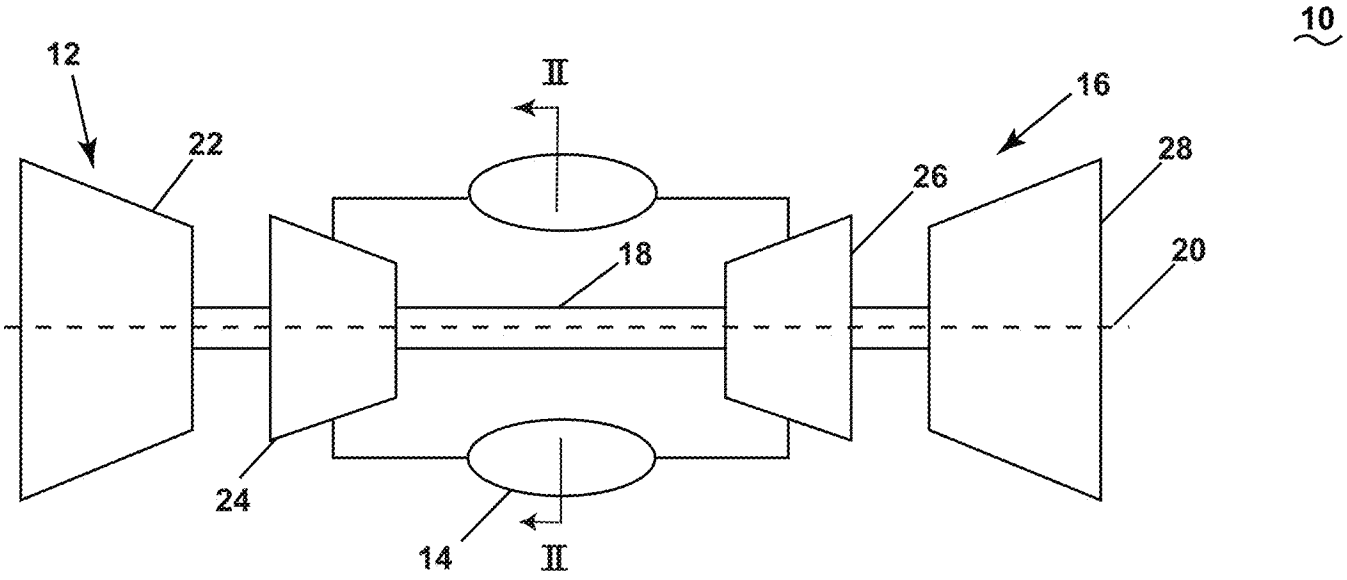
FIG. 1 is a schematic representation of a turbine engine, the turbine engine including a compression section, a combustion section, and a turbine section, in accordance with an aspect of the present disclosure.

Aspects of the disclosure herein are directed to a fuel injector located within an engine, and more specifically, to a fuel injector for supplying a fuel, air, inert gas, or mixtures thereof to a combustor for combustion within a turbine engine. For purposes of illustration, the present disclosure will be described with respect to a fuel injector located within the combustor for a turbine engine. It will be understood, however, that aspects of the disclosure herein are not so limited and may have general applicability within an engine that combusts a fuel to drive the engine. This disclosure is applicable to other non-aircraft applications or other turbine environments. Non-limiting examples of where this disclosure can be applied include other mobile applications and non-mobile industrial, commercial, and residential applications.

Goals to reduce emissions generated by the use of turbine engines include the reduction of emissions, like $CO_2$, generated during the use of traditional engine fuels, like JET-A, or through the use of non-emission fuels, like hydrogen replacing traditional engine fuels.

Gaseous fuels, such as hydrogen and non-diluent hydrogen, have faster flame speeds, higher reactivity, greater flammability limits, and higher flame temperatures than that of liquid fuels or atomized liquid fuels. Such faster flame speed, higher reactivity, greater flammability, and higher flame temperatures can result in flashback, autoignition, or flame holding along portions of the fuel injector or the surrounding environment from which the gaseous fuels are emitted. For example, a laminar flame speed for hydrogen fuel can be about 10 times that of a laminar flame speed for hydrocarbon fuels. When fuels ignite with an oxidizer (like air, for example), hydrogen fuels require less ignition energy compared with that of hydrocarbon fuels when utilized with the same oxidizer. Such flashback, autoignition, or flame holding can impact durability of the fuel injector. The fuel injector described herein is capable of utilizing low-emission fuels with higher flame speeds, as well as achieving mixing of the fuel and air to ensure low pressure drop and reduce, mitigate, or eliminate the opportunity for flashback, flame holding, and autoignition at the fuel injector.

Additionally, aspects of the disclosure herein provide a fuel injector capable of use or incorporation of low emission fuels, such as hydrogen fuels or fuels that are capable of zero emissions, zero carbon emissions, near-zero emissions, or near-zero carbon emissions. In a non-limiting example, such a fuel can be a pure form of hydrogen without any diluents, or a non-diluent hydrogen gas fuel. In some examples, no diluent is added to the hydrogen fuel and the fuel is substantially completely diatomic hydrogen without diluent. As used herein, the term "substantially completely," as used to describe the amount of a particular element or molecule (e.g., diatomic hydrogen), refers to at least 99% by mass of the described portion of the element or molecule, such as at least 97.5%, such as at least 95%, such as at least 92.5%, such as at least 90%, such as at least 85%, or such as at least 75% by mass of the described portion of the element or molecule.

The turbine engine and the fuel injector, as described herein, are especially well adapted for the use of hydrogen fuel (hereinafter, "H2 fuel"), while the use of non-hydrogen fuels or hydrogen mixes is contemplated. Specifically, the turbine engine is especially well adapted to feed a flow of H2 fuel to the combustion chamber. The flow of H2 fuel can include a gaseous H2 fuel, a liquid H2 fuel, or a combination thereof. The flow of H2 fuel can further be mixed with other fuels or fluids such as, but not limited to, natural gas, syngas, coke oven gas, diesel, Jet-A, or the like. H2 fuels, when compared to traditional fuels (e.g., carbon fuels, petroleum fuels, etc.), have a higher burn temperature and velocity. Further, the H2 fuel, once fed to the combustion chamber, spreads out faster than traditional fuels. Ensuring that the H2 fuel has a desired momentum, mixture, or flow rate when being fed to the combustion chamber ensures that the H2 fuel does not ignite early or spread to undesired regions. The fuel injector described herein permits suitable intermixing of H2 fuel and air to mitigate or prevent flame holding at the fuel injector or flashback.

As used herein, the term "gaseous fuel" or iterations thereof refers to a combustible fuel in a gaseous state. It will be appreciated that gaseous fuel is different from atomized fuel. Atomized fuel utilizes an impeller, orifices, or other means to take a liquid fuel and atomize the liquid fuel into very small droplets.

For purposes of illustration, the present disclosure will be described with respect to a turbine engine (such as a gas turbine engine). It will be understood, however, that aspects of the disclosure described herein are not so limited and that a combustion section and fuel supply as described herein can be implemented in engines, including but not limited to turbojet, turboprop, turboshaft, and turbofan engines. Aspects of the disclosure discussed herein may have general applicability within non-aircraft engines having a combustion section and fuel supply, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first," "second," and "third," may be used interchangeably to distinguish one component from another and are not intended to signify location or importance of the individual components.

The terms "forward" and "aft" refer to relative positions within a turbine engine or vehicle and refer to the normal operational attitude of the turbine engine or vehicle. For example, with regard to a turbine engine, forward refers to a position closer to an engine inlet and aft refers to a position closer to an engine exhaust.

As used herein, the term "upstream" refers to a direction that is opposite the fluid flow direction, and the term "downstream" refers to a direction that is in the same direction as the fluid flow.

The term "fluid" may be a gas or a liquid. The term "fluidly coupled" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a," "an," and "the" include plural references unless the context clearly dictates otherwise. Furthermore, as used herein, the term "set" or a "set" of elements can be any number of elements, including only one.

FIG. 1 is a schematic view of a turbine engine 10. As a non-limiting example, the turbine engine 10 can be used within an aircraft. The turbine engine 10 includes, at least, a compression section 12, a combustion section 14, and a turbine section 16 in serial flow arrangement. A drive shaft 18 rotationally couples the compression section 12 and the turbine section 16, such that rotation of one affects the rotation of the other and defines a rotational axis or engine centerline 20 for the turbine engine 10.

The compression section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 operatively couples the LP compressor 22, the HP compressor 24, the LP turbine 28 and the HP turbine 26 together. Additionally, it is contemplated that the drive shaft 18 can include an LP drive shaft (not shown) and an HP drive shaft (not shown). The LP drive shaft couples the LP compressor 22 to the LP turbine 28, and the HP drive shaft couples the HP compressor 24 to the HP turbine 26. An LP spool is defined as the combination of the LP compressor 22, the LP turbine 28, and the LP drive shaft such that the rotation of the LP turbine 28 applies a driving force to the LP drive shaft, which in turn rotates the LP compressor 22. An HP spool is defined as the combination of the HP compressor 24, the HP turbine 26, and the HP drive shaft such that the rotation of the HP turbine 26 applies a driving force to the HP drive shaft which in turn rotates the HP compressor 24.

The compression section 12 includes a plurality of axially spaced stages. Each stage includes a set of circumferentially spaced rotating blades and a set of circumferentially spaced stationary vanes. The compressor blades for a stage of the compression section 12 can be mounted to a disk, which is mounted to the drive shaft 18. Each set of blades for a given stage can have its own disk. The vanes of the compression section 12 can be mounted to a casing which can extend circumferentially about the turbine engine 10. It will be appreciated that the representation of the compression section 12 is merely schematic and that there can be any number of stages. Further, it is contemplated that there can be any other number of components within the compression section 12.

Similar to the compression section 12, the turbine section 16 includes a plurality of axially spaced stages, with each stage having a set of circumferentially spaced, rotating blades and a set of circumferentially spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated that there can be any other number of components within the turbine section 16.

The combustion section 14 is provided serially between the compression section 12 and the turbine section 16. The combustion section 14 is fluidly coupled to at least a portion of the compression section 12 and the turbine section 16 such that the combustion section 14 at least partially fluidly couples the compression section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compression section 12 via a fan (not illustrated) upstream of the compression section 12, where the air is compressed defining a compressed air. The compressed air then flows into the combustion section 14 where the compressed air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The compressed air flow and the combustion gases can together define a working air flow that flows through the fan, compression section 12, combustion section 14, and turbine section 16 of the turbine engine 10.

Figure 2:
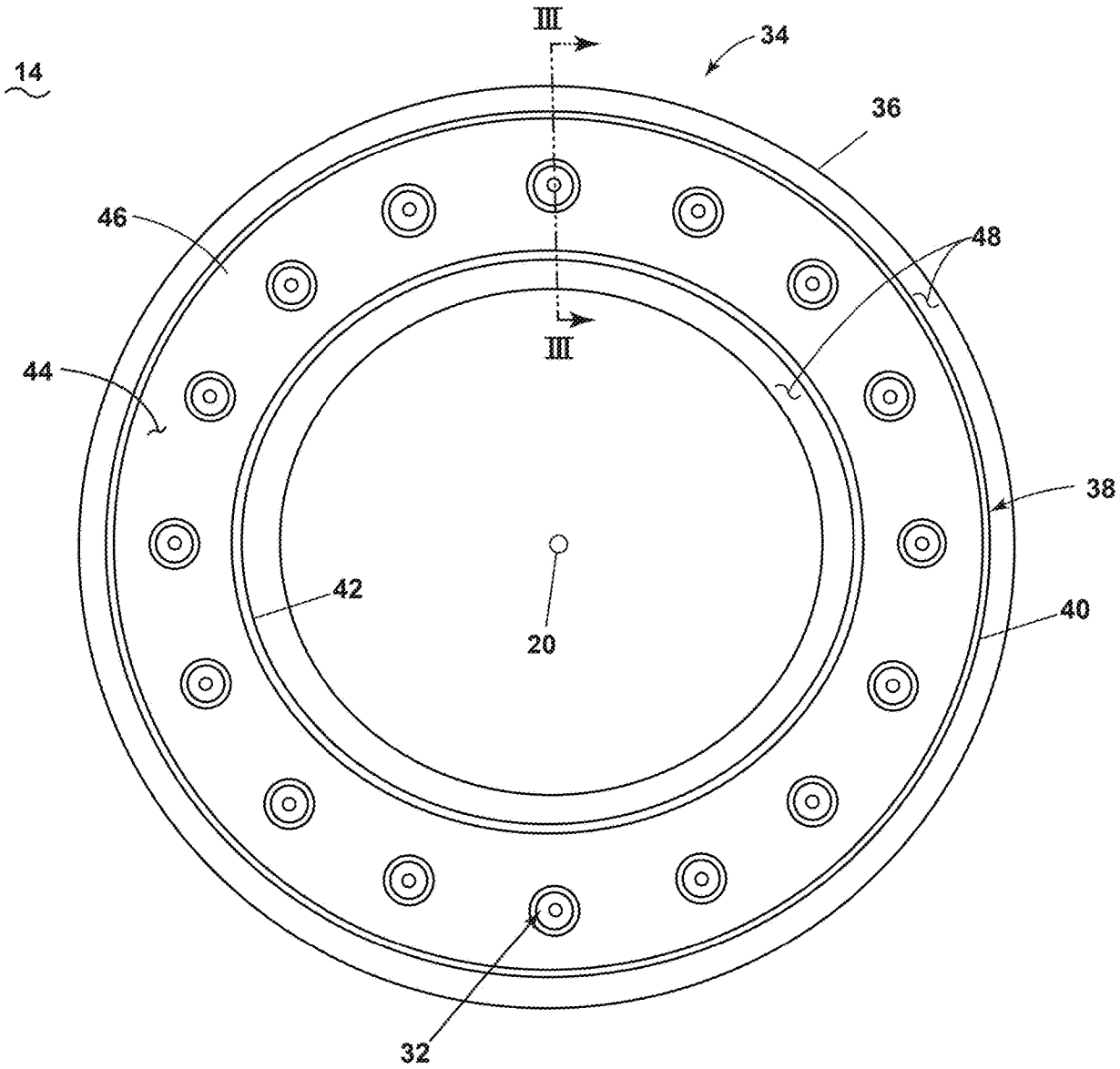
FIG. 2 depicts a cross-sectional view of the combustion section taken along line II-II of FIG. 1, further illustrating a set of fuel injectors, in accordance with an aspect of the present disclosure.

FIG. 2 depicts a cross-sectional view of the combustion section 14 along line II-II of FIG. 1. For purposes of illustration, the drive shaft 18 (FIG. 1) has been removed. The combustion section 14 includes a combustor 34. The combustor 34 includes a dome wall 44 including a set of fuel injector assemblies 32 in annular arrangement about the engine centerline 20.

A set of fuel injector assemblies 32 can include rich cups, lean cups, or a combination of both rich and lean cups. It should be appreciated that the annular arrangement of the set of fuel injector assemblies 32 can include any number of fuel injector assemblies, including one or multiple fuel injector assemblies, and one or more of the fuel injector assemblies can have similar or different characteristics. The combustor 34 is defined, at least in part, by a combustor liner 38. The combustor 34 can have a can, can-annular, or annular arrangement depending on the type of engine in which the combustor 34 is located. In a non-limiting example, the combustor 34 can have a combination arrangement as further described herein located within a casing 36 of the engine. The combustor liner 38, as illustrated by way of example, can be annular. The combustor liner 38 can include an outer combustor liner 40 and an inner combustor liner 42 concentric with respect to each other and annular about the engine centerline 20. The dome wall 44 together with the combustor liner 38 can define a combustion chamber 46 having an annular configuration disposed about the engine centerline 20. The set of fuel injector assemblies 32 can be fluidly coupled to the combustion chamber 46. A compressed air passageway 48 can be defined at least in part by both the combustor liner 38 and the casing 36.

Figure 3:
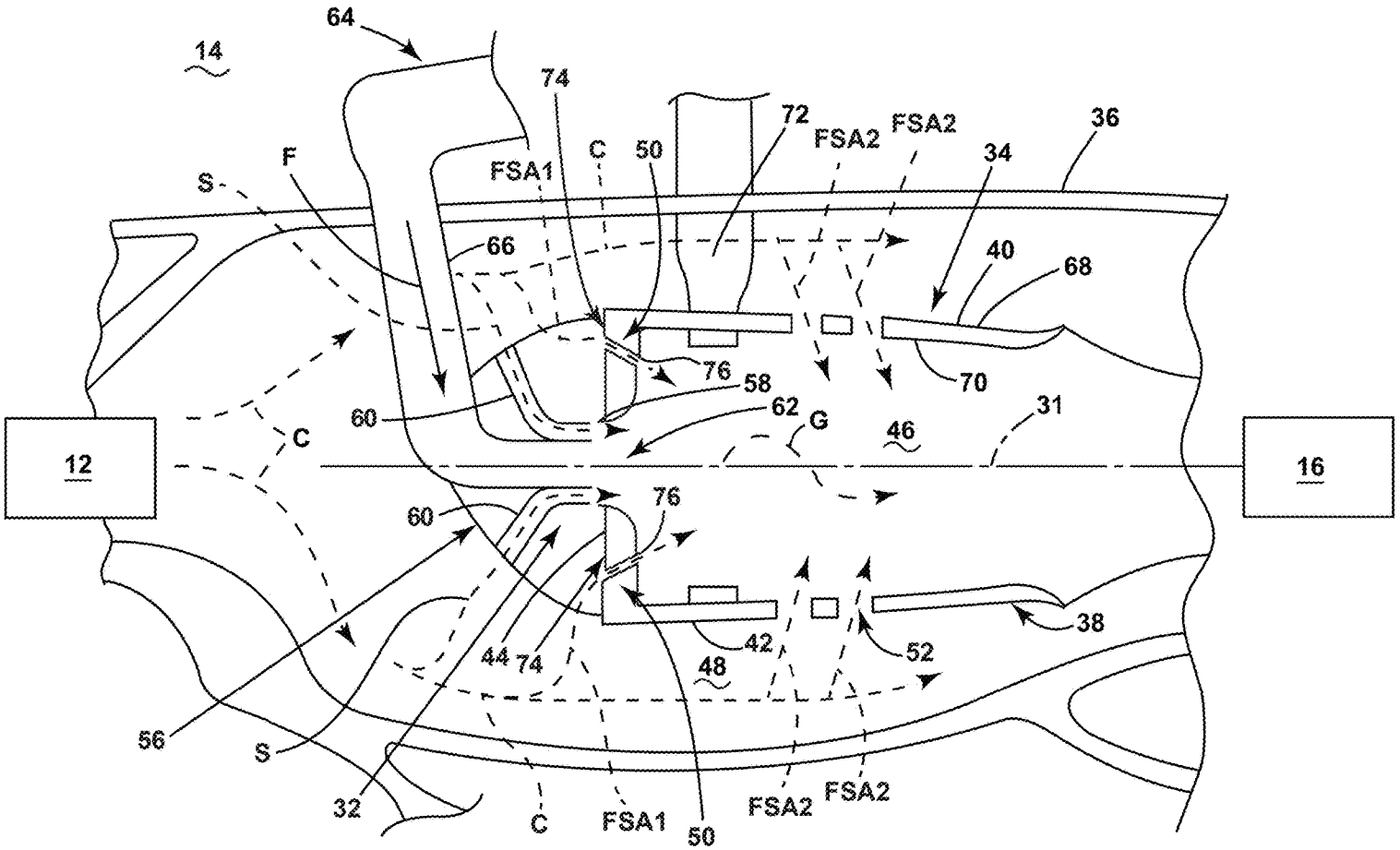
FIG. 3 is a schematic of a side sectional view taken along line III-III of FIG. 2, further illustrating one fuel injector of the set of fuel injectors exhausting into a combustion chamber, in accordance with an aspect of the present disclosure.

FIG. 3 depicts a cross-section view taken along line III-III of FIG. 2 illustrating the combustion section 14 between the compression section 12 and the turbine section 16. At least one flame shaping passage can fluidly connect compressed air and the combustion chamber 46. By way of example, the at least one flame shaping passage is illustrated as a first set of flame shaping holes 50 or a second set of flame shaping holes 52. The combustor 34 can include the first set of flame shaping holes 50, the second set of flame shaping holes 52, or both the first set of flame shaping holes 50 and the second set of flame shaping holes 52.

The first set of flame shaping holes 50 pass through the dome wall 44, fluidly coupling compressed air (C) from the compression section 12 or the compressed air passageway 48 to the combustion chamber 46. The second set of flame shaping holes 52 pass through the combustor liner 38, fluidly coupling compressed air from the compressed air passageway 48 to the combustion chamber 46.

Each fuel injector assembly of the set of fuel injector assemblies 32 can be coupled to and disposed within a dome assembly 56. Each fuel injector assembly of the set of fuel injector assemblies 32 can include a flare cone 58 and a swirler 60. The flare cone 58 includes an outlet 62 directly fluidly coupled to the combustion chamber 46. Each fuel injector assembly of the set of fuel injector assemblies 32 is fluidly coupled to a fuel inlet 64 via a passageway 66.

Both the inner combustor liner 42 and the outer combustor liner 40 have an outer surface 68 and an inner surface 70 at least partially defining the combustion chamber 46. The combustor liner 38 can be made of one continuous monolithic portion or be multiple monolithic portions assembled together to define the inner combustor liner 42 and the outer combustor liner 40. By way of non-limiting example, the outer surface 68 can define a first piece of the combustor liner 38 while the inner surface 70 can define a second piece of the combustor liner 38 that when assembled together form the combustor liner 38. As described herein, the combustor liner 38 includes the second set of flame shaping holes 52. It is further contemplated that the combustor liner 38 can be any type of combustor liner 38, including but not limited to a single wall or a double walled liner or a tile liner. An ignitor 72 can be provided at the combustor liner 38 and fluidly coupled to the combustion chamber 46, at any location, by way of non-limiting example upstream of the second set of flame shaping holes 52.

During operation, compressed air (C) from a compressed air supply, such as the LP compressor 22 or the HP compressor 24 of FIG. 1, can flow from the compression section 12 to the combustor 34. A portion of the compressed air (C) can flow through the dome assembly 56. A first part of the compressed air (C) flowing through the dome assembly 56 can be fed to each fuel injector assembly of the set of fuel injector assemblies 32 via the swirler 60 as a swirled airflow(S). A supply of fuel (F) is fed to each fuel injector assembly of the set of fuel injector assemblies 32 via the fuel inlet 64 and the passageway 66. The swirled airflow(S) and the supply of fuel (F) are mixed at the flare cone 58 and fed to the combustion chamber 46 as a fuel/air mixture. The ignitor 72 can ignite the fuel/air mixture to define a flame within the combustion chamber 46, which generates a combustion gas (G). While shown as starting axially downstream of the outlet 62, it will be appreciated that the fuel/air mixture can be ignited at or near the outlet 62.

A second part of the compressed air (C) flowing through one or more portions of the dome assembly 56 can be fed to the first set of flame shaping holes 50 as a first flame shaping airflow (FSA1). That is, a portion of the compressed air (C) from the compression section 12 can flow through the dome wall 44 and into the combustion chamber 46 by passing through the first set of flame shaping holes 50. An inlet 74 is defined by a portion of one or more flame shaping holes of the first set of flame shaping holes 50. The inlet 74 is fluidly coupled to the compressed air (C). The first flame shaping airflow (FSA1) enters the one or more flame shaping holes of the first set of flame shaping holes 50 at the inlet 74 and exits the one or more flame shaping holes of the first set of flame shaping holes 50 at an outlet 76 located at an aft surface of the dome wall 44.

Another portion of the compressed air (C) can flow through the compressed air passageway 48 and can be fed to the second set of flame shaping holes 52 as a second flame shaping airflow (FSA2). In other words, another portion of the compressed air (C) can flow axially past the dome assembly 56 and enter the combustion chamber 46 by passing through the second set of flame shaping holes 52. That is, compressed air (C) can flow through the combustor liner 38 and into the combustion chamber 46 by passing through the second set of flame shaping holes 52.

The first flame shaping airflow (FSA1) can be used to direct and shape the flame. The second flame shaping airflow (FSA2) can be used to direct the combustion gas (G). In other words, the first set of flame shaping holes 50 or the second set of flame shaping holes 52 extending through the dome wall 44 or the combustor liner 38 direct compressed air (C) into the combustion chamber 46, where the directed compressed air (C) is used to control, shape, cool, or otherwise contribute to the combustion process in the combustion chamber 46.

The combustor 34 shown in FIG. 3 is well suited for the use of a hydrogen-containing gas as the fuel because it helps contain the faster moving flame front associated with hydrogen fuel, as compared to traditional hydrocarbon fuels. However, the combustor 34 can be used with other fuels, such as gaseous and liquid hydrocarbon fuels.

Figure 4:
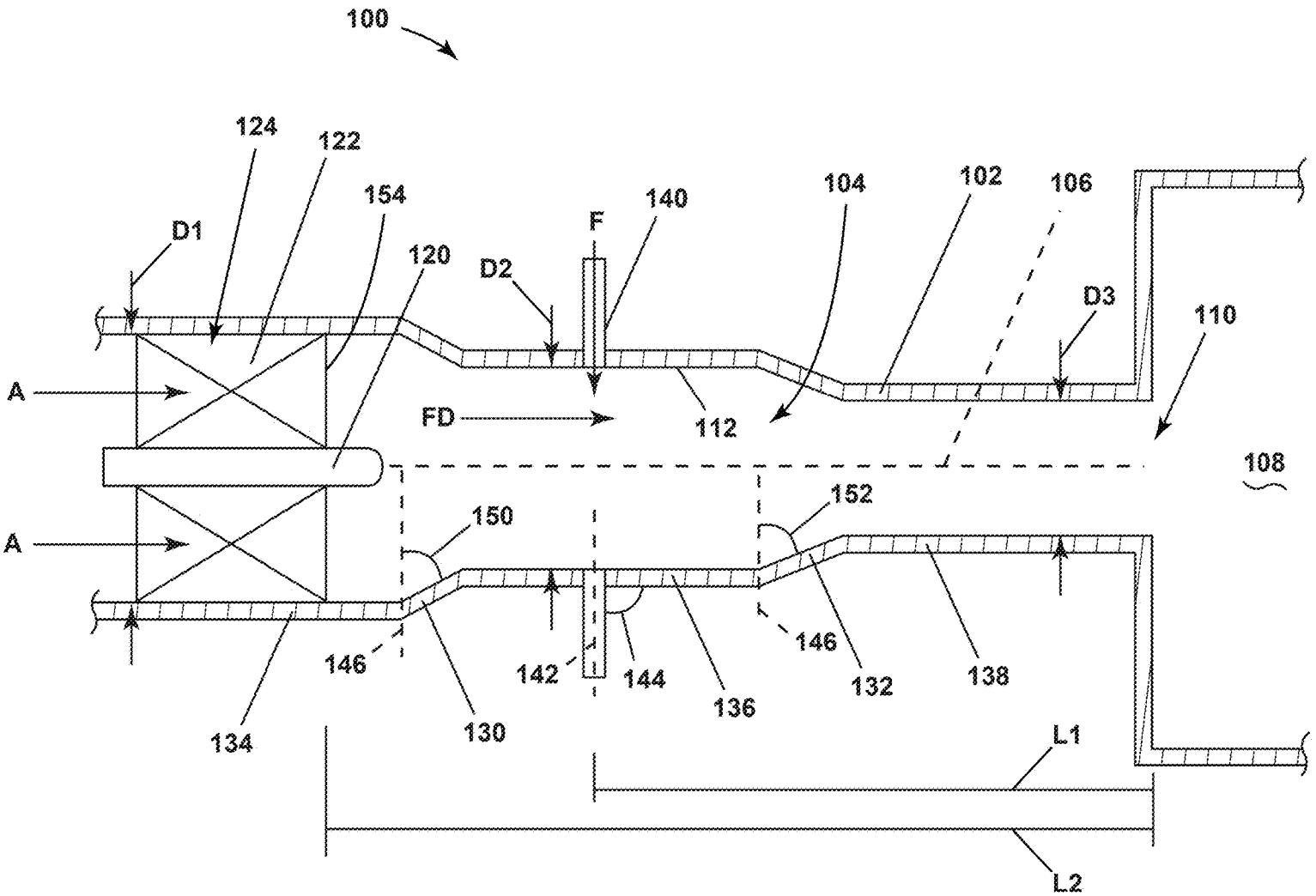
FIG. 4 is a schematic, cross-sectional view of a fuel injector for use within the set of fuel injectors of FIG. 3 and having a first converging portion and a second converging portion, in accordance with an aspect of the present disclosure.

FIG. 4 illustrates a cross-sectional view of a fuel injector 100 suitable for use within the set of fuel injector assemblies 32 of FIGS. 2 and 3. The fuel injector 100 can have a generally annular shape defined by an outer wall 102 surrounding an injector passage 104 defining a longitudinal injector axis 106. The fuel injector 100 exhausts to a combustion chamber 108 at an injector outlet 110, which can be the combustion chamber 46 of FIG. 3, for example, and defines a flow direction (FD) along the injector passage 104. The outer wall 102 includes an interior surface 112 that confronts the injector passage 104.

A centerbody 120 positions within the injector passage 104. The centerbody 120 can align along the longitudinal injector axis 106. A set of vanes 122 can extend from the centerbody 120 to the outer wall 102 across the injector passage 104. The set of vanes 122 can define a swirler assembly 124 for the fuel injector 100, which can impart a swirl or tangential component to a flow of air (A) passing along the injector passage 104. In a non-limiting example, the swirler assembly 124 can be an axial swirler, imparting a swirl or tangential component to an axial flow of air (A) along the injector passage 104.

The outer wall 102 includes a first converging portion 130 and a second converging portion 132 positioned aft of the first converging portion 130. The injector passage 104 can include a first cylindrical portion 134, a second cylindrical portion 136, and a third cylindrical portion 138. The centerbody 120 positions interior of the first cylindrical portion 134, and the set of vanes 122 extend between the centerbody 120 and the outer wall 102 within the first cylindrical portion 134. The first converging portion 130 is positioned between and fluidly couples the first cylindrical portion 134 to the second cylindrical portion 136. The second converging portion 132 is positioned between and fluidly couples the second cylindrical portion 136 to the third cylindrical portion 138. The first, second, and third cylindrical portions 134, 136, 138 can define a constant cross-sectional area within each portion, with the cross-sectional area for the first cylindrical portion 134 being greater than the second cylindrical portion 136 and the cross-sectional area for the second cylindrical portion 136 being greater than the cross-sectional area of the third cylindrical portion 138.

A set of fuel passages 140 exhaust to the injector passage 104 through the outer wall 102 at the second cylindrical portion 136. The set of fuel passages 140 can extend radially, relative to the longitudinal injector axis 106, in annular arrangement about the outer wall 102. Each fuel passage of the set of fuel passages 140 can define a passage axis 142. A fuel passage angle 144 can be defined as the angle between the passage axis 142 and the outer wall 102, and can be greater than or equal to negative seventy-five degrees) (−75°) and less or equal to than seventy-five degrees) (75°), where zero degrees) (0°) is oriented perpendicular to the outer wall 102 at the second cylindrical portion 136. Greater angles from negative ninety degrees) (−90°) to ninety degrees) (90°) are contemplated. Such an angled orientation can be in an axial direction defined along the longitudinal injector axis 106, or can be angled relative to a radial axis 146 extending perpendicular from the longitudinal injector axis 106, or combinations thereof. In a non-limiting example, such an angled orientation can be tangential or partially tangential to the annular shape of the outer wall 102 to impart swirl to the supply of fuel (F) within the injector passage 104. In additional non-limiting examples, there may be multiple converging portions with cylindrical portions therebetween. Additionally, the introduction of multiple fuels is contemplated within such cylindrical portions, between the multiple converging portions. In yet another non-limiting example, fuel injection at the first or second converging portions 130, 132, or both, or in combination with fuel injection at one or more cylindrical portions, is contemplated. In additional non-limiting examples, fuel injected from the set of fuel passages 140 should be downstream of at least one converging portion, like the first converging portion 130, such that the fuel is injected at a position of the fuel injector 100 having a smaller radius, defined by the outer wall 102, than that of the swirler assembly 124.

The first converging portion 130 can define a first angle 150 relative to the radial axis 146, and the second converging portion 132 can define a second angle 152 relative to the radial axis 146. In a non-limiting example, the first angle 150 can be greater than zero degrees) (0°) and less than or equal to eighty-five degrees) (85°). In another non-limiting example, the second angle 152 can be greater than zero degrees) (0°) and less than or equal to eighty-five degrees) (85°). In another non-limiting example, it is contemplated that the first angle 150 and the second angle 152 are different. Such an angled orientation for the first and second converging portions 130, 132 accelerate the flow as well as decreasing the size of the fuel injector 100 extending toward the injector outlet 110.

A first diameter (D1) can be defined as the diameter of the inner surface 112 at the first cylindrical portion 134, a second diameter (D2) can be defined as the diameter of the inner surface 112 at the second cylindrical portion 136, and a third diameter (D3) can be defined as the diameter of the inner surface 112 at the third cylindrical portion 138. In a non-limiting example, the third diameter (D3) for the outer wall 102 can be greater than or equal to 0.06 inches (1.52 millimeters) and less than or equal to 0.8 inches (20.32 millimeters). In another non-limiting example, the third diameter (D3) for the outer wall 102 can be greater than or equal to 0.1 inches (2.54 millimeters) and less than or equal to 0.3 inches (7.62 millimeters). In yet another non-limiting example, the first diameter (D1) can be greater than or equal to 1.1 times the third diameter (D3) and less than or equal to ten times the third diameter (D3). That is, 1.1 (D3) $\leq$D1$\leq$10 (D3). In yet another non-limiting example, the first diameter (D1) can be greater than or equal to 1.1 times the third diameter (D3) and less than or equal to five times the third diameter (D3). That is, 1.1 (D3)$\leq$D1$\leq$5 (D3). In yet another non-limiting example, the second diameter (D2) can be greater than or equal to 1.1 times the third diameter (D3) and less than or equal to five times the third diameter (D3). That is, 1.1 (D3)$\leq$D2$\leq$5 (D3). In yet another non-limiting example, the second diameter (D2) can be greater than or equal to 1.1 times the third diameter (D3) and less than or equal to three times the third diameter (D3). That is, 1.1 (D3)$\leq$D2$\leq$3 (D3). Such a sizing provides suitable volume for the introduction of fuel and air, as well as intermixing thereof, as well as reducing the size and diameter of the fuel injector 100 extending toward the injector outlet 110.

A first length (L1) can be defined as the length between the set of fuel passages 140 and the injector outlet 110, taken parallel to the longitudinal injector axis 106. A second length (L2) can be defined as the length between an aft end 154 set of vanes 122 and the injector outlet 110, taken parallel to the longitudinal injector axis 106. In a non-limiting example, the first length (L1) can be greater than or equal to 0.1 times the third diameter (D3) and less than or equal to ten times the third diameter (3D). That is, 0.1 (D3)$\leq$L1$\leq$10 (D3). In another non-limiting example, the first length (L1) can be greater than or equal to one times the third diameter (D3) and less than or equal to ten times the third diameter (3D). That is, 1 (D3)$\leq$L1$\leq$10 (D3). In another non-limiting example, the second length (L2) can be greater than or equal to two times the third diameter (D3) and less than or equal to twenty times the third diameter (3D). That is, 2 (D3) $\leq$L2$\leq$20 (D3). Such a sizing for the fuel injector 100 permits suitable length and residence time for the fuel and air to intermix, while reducing size of the fuel injector 100 at the injector outlet 110.

While only a single "stage" comprising a converging portion and a cylindrical portion with a set of fuel passages, like the first converging portion 130, the second cylindrical portion 136, and the set of fuel passages 140 is shown, any number of "stages" are contemplated, such as having multiple converging portions and multiple cylindrical portions containing fuel passages is contemplated.

In operation, a flow of air (A) is provided to the injector passage 104 and can be swirled by the set of vanes 122 of the swirler assembly 124. The swirling flow of air (A) passes to the first converging portion 130, where the flow of air (A) is accelerated, and passes to the second cylindrical portion 136. A supply of fuel (F) is provided to the injector passage 104 through the set of fuel passages 140 at the second cylindrical portion 136 where the supply of fuel (F) intermixes with the flow of air (A). A mixture of the flow of air (A) and the supply of fuel (F) passes to the second converging portion 132, where the mixture is accelerated and passes to the third cylindrical portion 138. The mixture is then exhausted to the combustion chamber 108.

The fuel injector 100 provides improved flame stability for the flame in the combustion chamber 108, permits wider operability, and reduces flashback. Such benefits permit the reduction of emissions, like NOx emissions. The fuel injector 100 includes the first and second converging portions 130, 132, which reduce the diameter of the outer wall 102 as it extends toward the combustion chamber 108. The reduction in diameter permits relatively smaller diameters for the injector outlet 110, which provides a relatively reduced flame length and relatively reduced residence time within the flame front, which reduces the opportunity for occurrence of flashback due to relatively reduced heat loss to the adjacent wall structure. Additionally, a sudden contraction of diameter for the injector passage 104 created by the first and second converging portions 130, 132, for example, creates a high-turbulence wake which further facilitates intermixing of the fuel and air.

Injection of the supply of fuel (F) at the second cylindrical portion 136 provides injection of fuel to the flow of air (A) into a relatively low velocity region, relative to an increased velocity within the third cylindrical portion 138, which permits greater penetration of the supply of fuel (F), which facilitates intermixing among the fuel and air. The second converging portion 132 then further increases velocity of the mixture of the supply of fuel (F) and the flow of air (A), which mitigates flashback. Additionally, injection of the supply of fuel (F) downstream of the provision of the flow of air (A) can mitigate flashback and flame holding. Provision of the fuel injection in a high velocity region, being relative to that of the first cylindrical portion 134 having a relatively lesser velocity, mitigates flame holding within the injector passage 104.

Use of the swirler assembly 124 increases kinetic energy within the flow of air (A), which increases intermixing of the flow of air (A) and the supply of fuel (F). The larger diameter at the swirler assembly 124, relative to the smaller diameter portions of the fuel injector 100, reduces aerodynamic losses associated with the swirler assembly 124, while the reduction in diameter permits a smaller diameter at the injector outlet 110. Additionally, such a larger diameter for the swirler assembly 124 provides additional room to account for flow blockage created by the set of vanes 122. Injection of the supply of fuel (F) to the second cylindrical portion 136 injects the fuel into a higher velocity region than that of at the swirler assembly 124 within the first cylindrical portion 134, which reduces the occurrence of flame holding within the injector passage 104.

In a non-limiting example, it is contemplated that the swirler assembly 124 is not limited to an axial swirler, and can be arranged as a radial swirler, or a set of radially oriented air passages, such as those discussed in FIGS. 11-15. In a non-limiting example, such radially oriented air passages can be circular in cross-section, while additional cross-sectional shapes are within the scope of this disclosure. In additional non-limiting examples, an axial swirler, a radial swirler, or both can be utilized.

Figure 5:
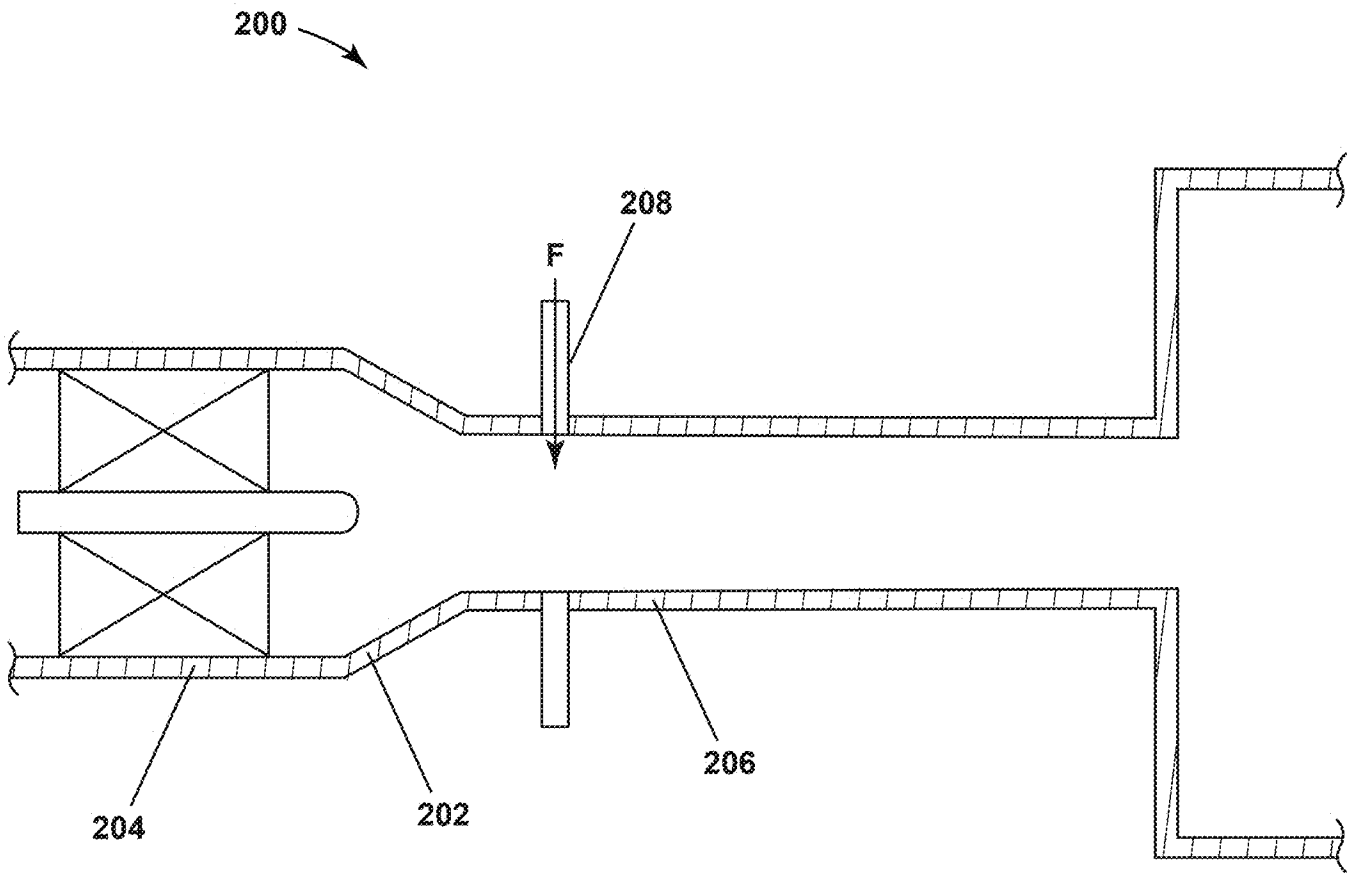
FIG. 5 is a schematic, cross-sectional view of a fuel injector for use within the set of fuel injectors of FIG. 3 and having a converging portion, in accordance with an aspect of the present disclosure.

FIG. 5 illustrates a cross-sectional view of a fuel injector 200 suitable for use within the set of fuel injector assemblies 32 of FIGS. 2 and 3. The fuel injector 200 can be substantially similar to the fuel injector 100 of FIG. 4, and therefore, the discussion will be limited to differences between the two. More specifically, FIG. 5 includes one converging portion as a first converging portion 202 between a first cylindrical portion 204 and a second cylindrical portion 206 while FIG. 4 includes the first and second converging portion 130, 132.

A supply of fuel (F) is injected from a set of fuel passages 208 downstream of the first converging portion 202. The supply of fuel (F) is injected into a relatively high-velocity region within the second cylindrical portion 206, compared to that of the first cylindrical portion 204. Injection of the supply of fuel (F) into such a high-velocity region can reduce or mitigate flame holding.

Figure 6:
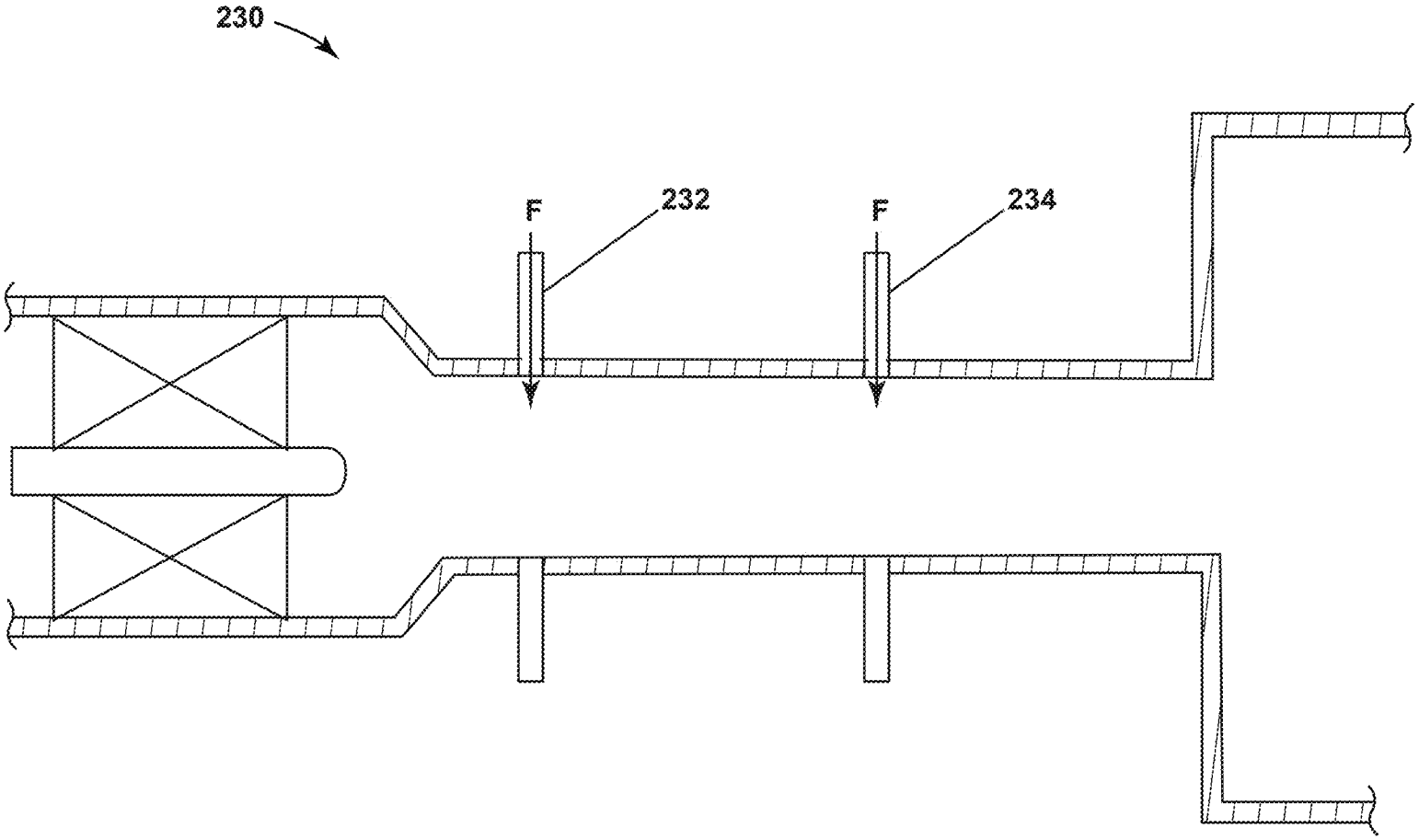
FIG. 6 is a schematic, cross-sectional view of a fuel injector for use within the set of fuel injectors of FIG. 3 and having a first set of fuel passages and a second set of fuel passages, in accordance with an aspect of the present disclosure.

FIG. 6 illustrates a cross-sectional view of a fuel injector 230 suitable for use within the set of fuel injector assemblies 32 of FIGS. 2 and 3. The fuel injector 230 can be substantially similar to the fuel injector 200 of FIG. 5, and therefore, the discussion will be limited to differences between the two. More specifically, the fuel injector 230 of FIG. 6 includes a first set of fuel passages 232 axially spaced forward of a second set of fuel passages 234, while the fuel injector 200 of FIG. 5 includes the set of fuel passages 208 at a single axial position.

The first and second sets of fuel passages 232, 234 permit the use of two separate fuels within the fuel injector 230. Such separate fuels can be utilized separately or individually controlled, such as during different engine conditions, while it is contemplated that the separate fuels may be used simultaneously. In a non-limiting example, the first set of fuel passages 232 can be used to provide fuel during a high-power condition, which provides a relatively larger mixing length between the air and fuel, which can reduce emissions. In another non-limiting example, the second set of fuel passages 234 has a relatively smaller mixing length which can provide for greater flame stability to reduce flashback, and can be used to provide fuel during a low power condition.

Figure 7:
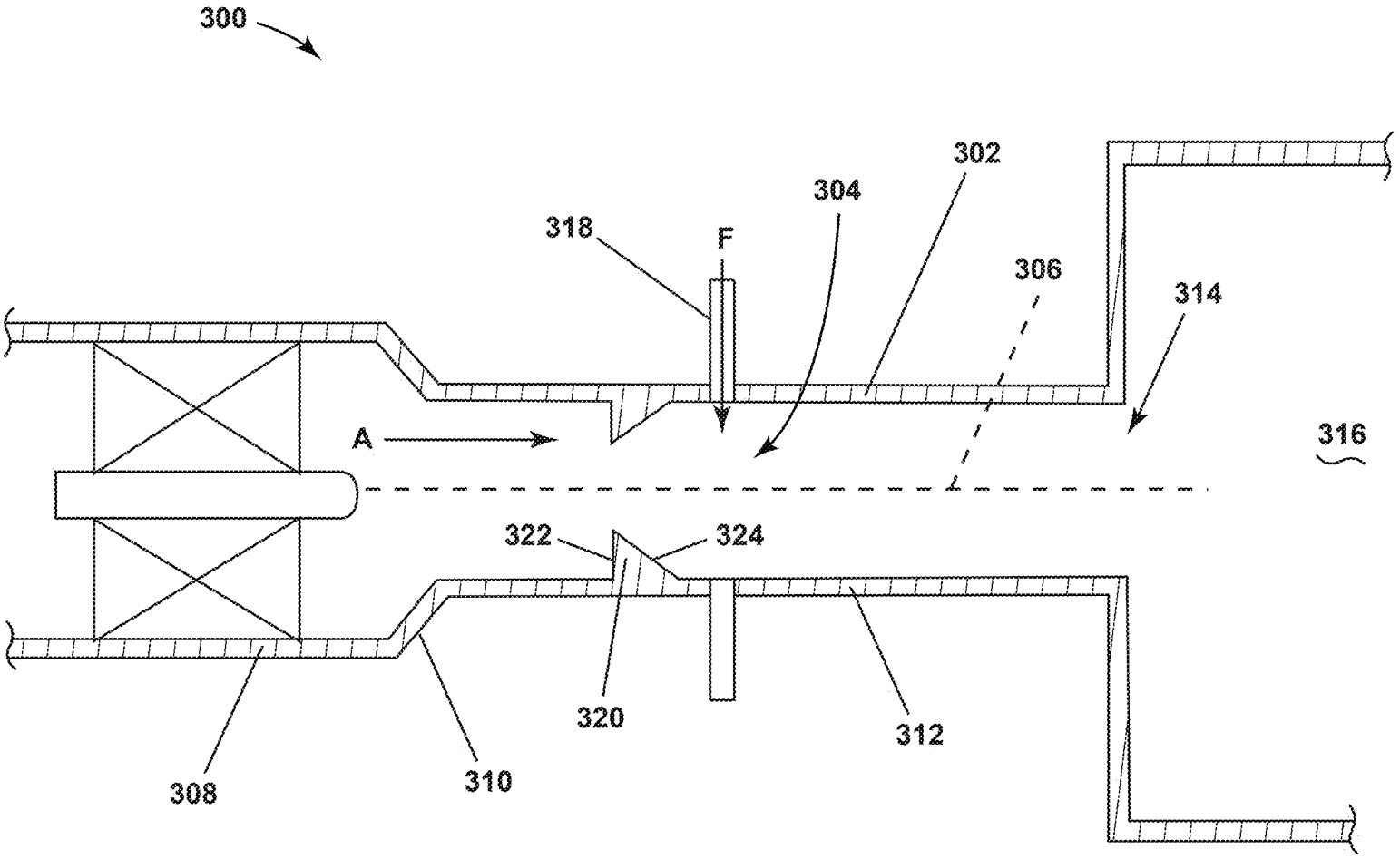
FIG. 7 is a schematic, cross-sectional view of a fuel injector for use within the set of fuel injectors of FIG. 3 and having a first fuel supply with a set of turbulators positioned upstream of a set of fuel passages, in accordance with an aspect of the present disclosure.

FIG. 7 illustrates a cross-sectional view of a fuel injector 300 suitable for use within the set of fuel injector assemblies 32 of FIGS. 2 and 3. The fuel injector 300 includes an outer wall 302 defining an injector passage 304 defining a longitudinal injector axis 306. The outer wall 302 includes a first cylindrical portion 308, a converging portion 310, and a second cylindrical portion 312 exhausting at an injector outlet 314 to a combustion chamber 316. A set of fuel passages 318 pass through the outer wall 302 in the second cylindrical portion 312, and can be arranged perpendicular to the longitudinal injector axis 306.

A set of turbulators 320 extend into the injector passage 304 from the outer wall 302 in annular arrangement about the longitudinal injector axis 306. In a non-limiting example, the set of turbulators 320 can be arranged as multiple turbulators in annular arrangement about the interior of the outer wall 302. In another non-limiting example, the set of turbulators 320 can be arranged as a single annular turbulator extending about the circumference of the outer wall 302. The set of turbulators 320 are positioned forward of the set of fuel passages 318.

The set of turbulators 320 have a triangular cross-sectional shape as illustrated, with a forward surface 322 extending radially inward from the outer wall 302 and an angled surface 324 returning to the outer wall 302 from the forward surface 322. It should be understood that the turbulators 320 need not be limited to the triangular shape, and can included any cross-sectional shape, including but not limited to circular, squared, rectangular, triangular, oval, elliptical, linear, curved, curvilinear, pins, bumps, divots, or combinations thereof.

The set of turbulators 320 increase turbulence for a flow of air (A) within the injector passage 304. Such increased turbulence provides for greater intermixing among the flow of air (A) and a supply of fuel (F), which provides for a reduction in emissions.

Figure 8:
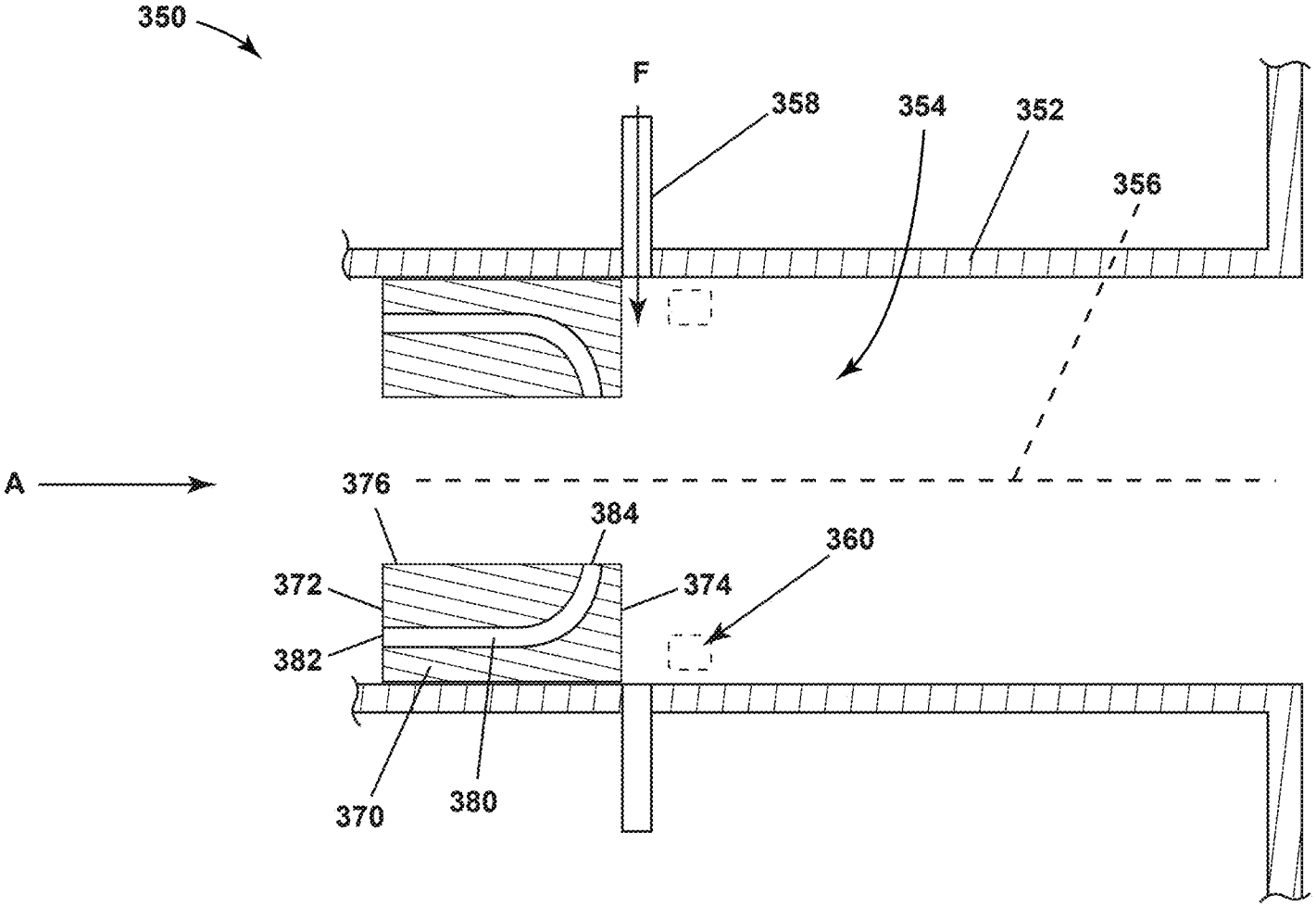
FIG. 8 is a schematic, cross-sectional view of a fuel injector for use within the set of fuel injectors of FIG. 3 and having a set of fuel passages and an annular body upstream of the set of fuel passages, in accordance with an aspect of the present disclosure.

FIG. 8 illustrates a cross-sectional view of a fuel injector 350 suitable for use within the set of fuel injector assemblies 32 of FIGS. 2 and 3. The fuel injector 350 includes an outer wall 352 defining an injector passage 354 defining a longitudinal injector axis 356. A set of fuel passages 358 extend through the outer wall 352 in annular arrangement.

A flow of air (A) and a supply of fuel (F) is provided to the injector passage 304. The radial injection of the supply of fuel (F) can result in a bluff region 360 downstream of the set of fuel passages 358.

An annular body 370 positions within the injector passage 354 along the outer wall 352 upstream of the set of fuel passages 358 and includes a forward surface 372, an aft surface 374, and a side surface 376. In non-limiting examples, the annular body 370 can be positioned immediately upstream of the set of fuel passages 358, can be positioned with the aft surface 374 aligned with the set of fuel passages 358, or both. A set of flow passages 380 extend through the annular body 370, each flow passage of the set of flow passages 380 having an inlet 382 on the forward surface 372 and an outlet 384 on the side surface 376.

It should be appreciated that while FIG. 8 is depicted without converging portions, the fuel injector 350 can include converging portions, such as one or more of the first or second converging portions 130, 132 of FIG. 4, the first converging portion 202 of FIG. 5, or the converging portion 310 of FIG. 7, in non-limiting examples. Such converging portions can be provided upstream of the annular body 370, for example. Furthermore, while FIG. 8 is depicted without a swirler assembly, it is contemplated that the fuel injector 350 can include a swirler assembly, like the swirler assembly 124 of FIG. 4 for example, which may be provided upstream of a converging portion.

In operation, a portion of the flow of air (A) passes from the injector passage 354 into the flow passage 380 at the inlet 382 and exhausts through the outlet 384, returning to the injector passage 354 upstream of the set of fuel passages 358. The flow of air (A) exhausting from the flow passage 380 is offset from the flow of air (A) passing through the injector passage 354, and can energize the bluff region 360, thereby reducing and mitigating the occurrence of flame holding which may result due to the existence of the bluff region 360. In this way, the annular body 370 and set of flow passages 380 can provide for mitigating flame holding for the fuel injector 350, as well as appreciating the emission-reducing benefits of the fuel injector 350.

Figure 9:
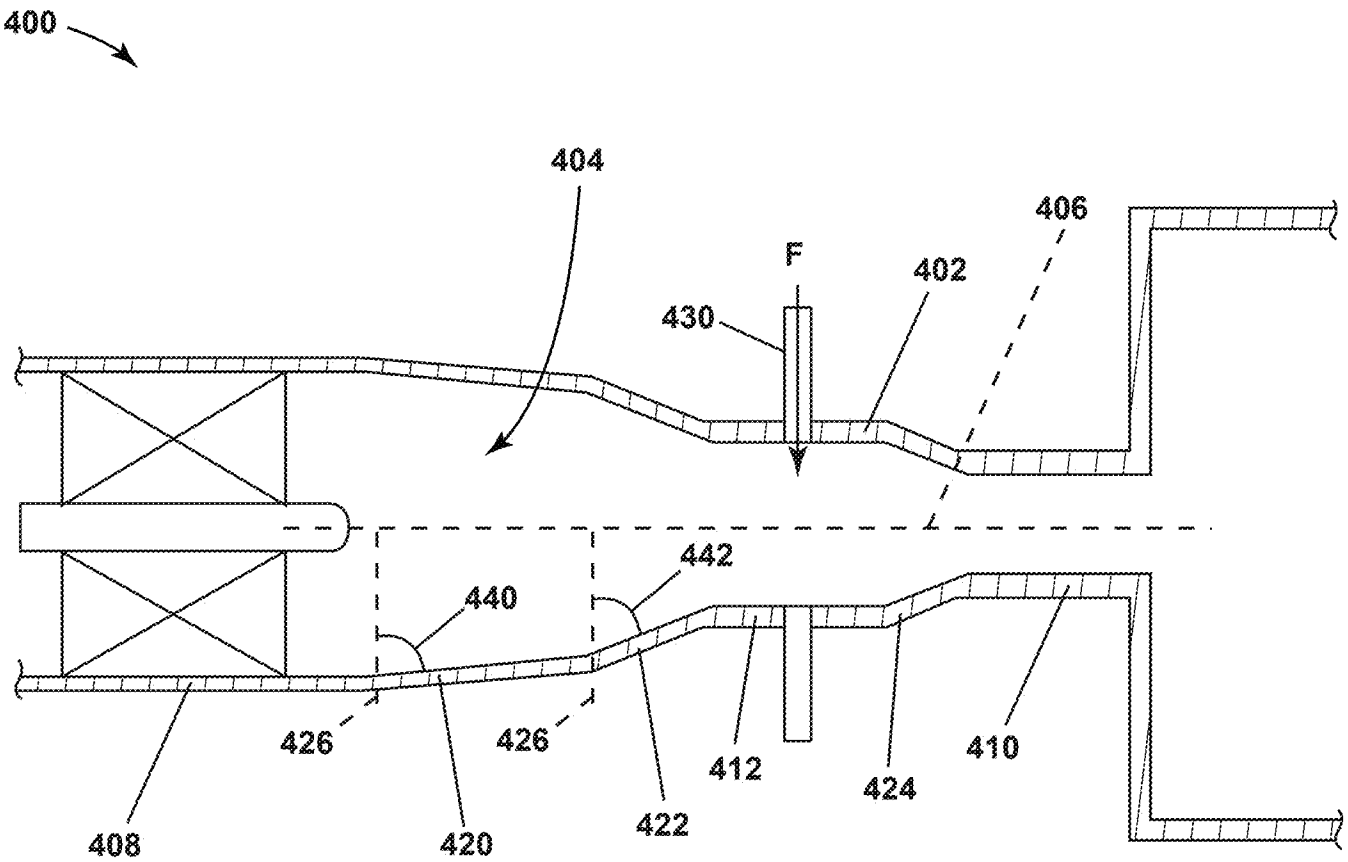
FIG. 9 is a schematic, cross-sectional view of a fuel injector for use within the set of fuel injectors of FIG. 3 and having a first converging portion and a second converging portion extending from the first converging portion, in accordance with an aspect of the present disclosure.

FIG. 9 illustrates a cross-sectional view of a fuel injector 400 suitable for use within the set of fuel injector assemblies 32 of FIGS. 2 and 3. The fuel injector 400 includes an outer wall 402 defining an injector passage 404 defining a longitudinal injector axis 406. The outer wall 402 includes a first cylindrical portion 408, a second cylindrical portion 410, and a third cylindrical portion 412. A first converging portion 420 extends from the first cylindrical portion 408 and a second converging portion 422 extends from the first converging portion 420 to the second cylindrical portion 410. A third converging portion 424 extends between the second cylindrical portion 410 and the third cylindrical portion 412. A set of fuel passages 430 pass through the outer wall 402 in the second cylindrical portion 410, and can be arranged perpendicular to the longitudinal injector axis 406, while non-perpendicular arrangements are contemplated.

The first converging portion 420 can be arranged at a first angle 440 relative to a radial axis 426 extending perpendicular to the longitudinal injector axis 406 and the second converging portion 422 can be arranged at a second angle 442 relative to the radial axis 426. The first angle 440 can be greater than the second angle 442, such that the second converging portion 422 converges at a different rate, such as a greater rate, than that of the first converging portion 420.

Figure 10:
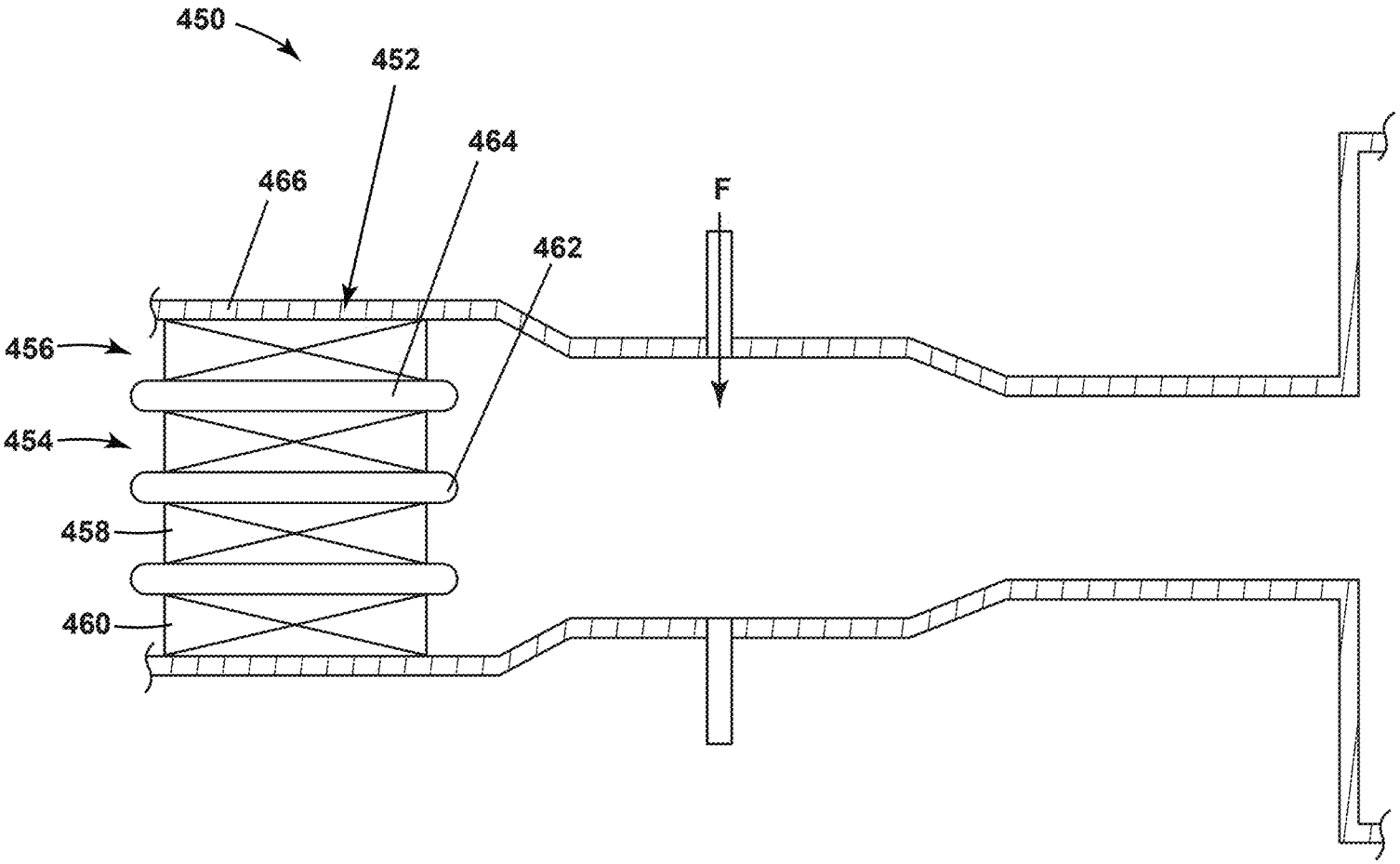
FIG. 10 is a schematic, cross-sectional view of a fuel injector for use within the set of fuel injectors of FIG. 3 and having a first swirler and a second swirler arranged radially exterior of the first swirler, in accordance with an aspect of the present disclosure.

FIG. 10 illustrates a cross-sectional view of a fuel injector 450 suitable for use within the set of fuel injector assemblies 32 of FIGS. 2 and 3. The fuel injector 450 can be substantially similar to the fuel injector 100 of FIG. 4, and therefore, the discussion will be limited to differences between the two. More specifically, the fuel injector 450 of FIG. 10 includes a swirler assembly 452 with a radially stacked arrangement having a radially inner swirler 454 and a radially outer swirler 456. The radially inner swirler 454 includes a first set of vanes 458 and the radially outer swirler 456 includes a second set of vanes 460. A centerbody 462 positions interior of the first set of vanes 458, and a swirler body 464 positions in annular arrangement about the centerbody 462, with the first set of vanes 458 extending between the centerbody 462 and the swirler body 464, and with the second set of vanes 460 extending between the swirler body 464 and an outer wall 466.

The radially inner and outer swirlers 454, 456 can provide for similar or different swirls for airflows provided from the swirler assembly 452. In a non-limiting example, the radially inner and outer swirlers 454, 456 can have a co-swirling relationship, providing a swirling airflow in a common tangential direction. In such an example, the radially inner swirler 454 and the radially outer swirler 456 can have the same swirl number, or can have different swirl numbers. In another non-limiting example, the radially inner and outer swirlers 454, 456 can be counter-swirling, providing swirling airflows in opposite tangential directions. In additional non-limiting examples, it is contemplated that only the first set of vanes 458 are provided or only the second set of vanes 460 are provided, with no vanes in either of the radially inner swirler 454 or the radially outer swirler 456, providing a non-swirled flow of air radially interior or exterior of a swirler flow of air. In a non-limiting example, a swirl number for one or both of the radially inner swirler 454 and the radially outer swirler 456 can be less than or equal to 0.35, defining a low or medium swirl generated by the radially inner swirler 454, the radially outer swirler 456, or both.

Figure 11:
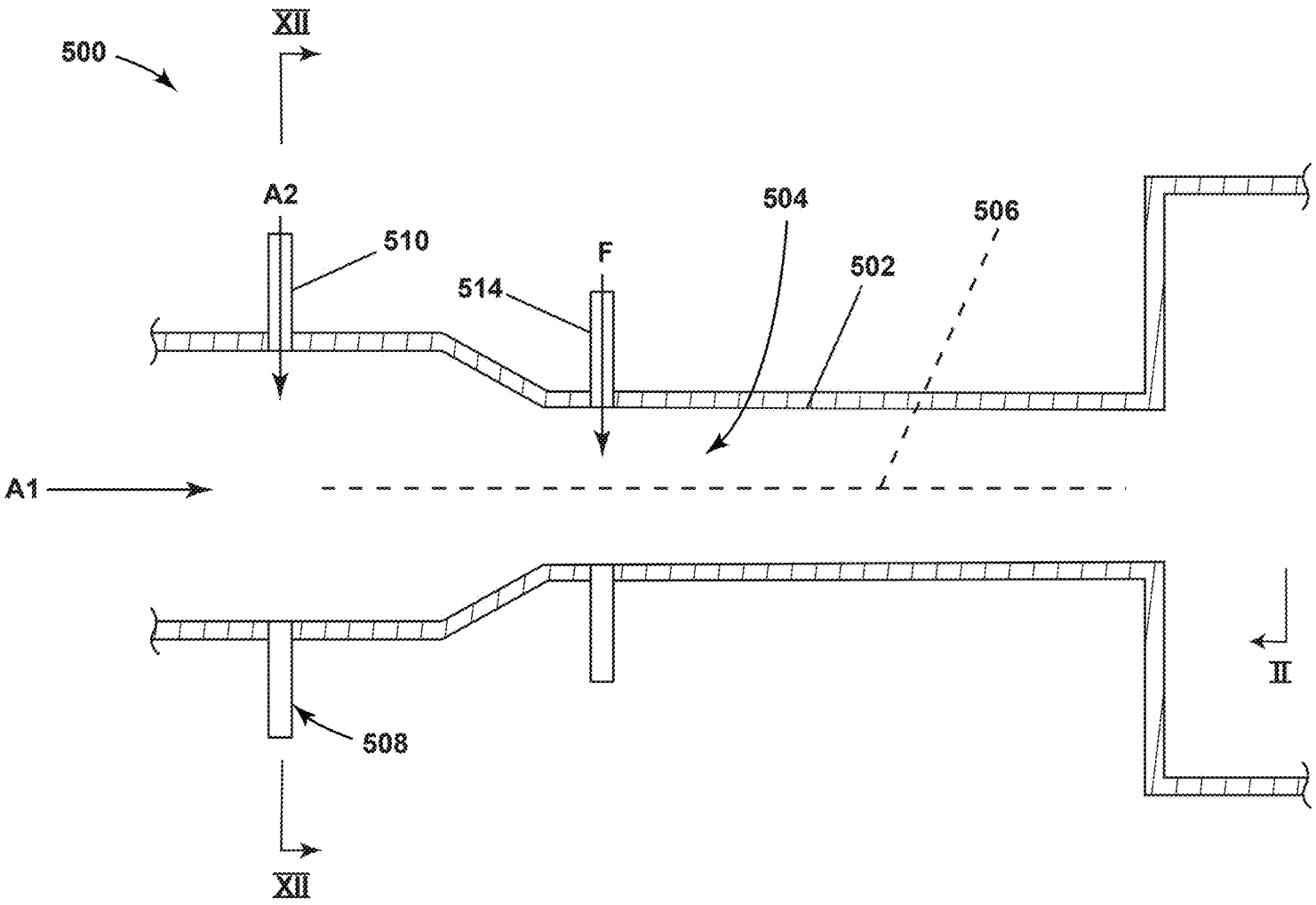
FIG. 11 is a schematic, cross-sectional view of a fuel injector for use within the set of fuel injectors of FIG. 3 and having a set of radial air passages positioned upstream of a converging portion, in accordance with an aspect of the present disclosure.

FIG. 11 illustrates a cross-sectional view of a fuel injector 500 suitable for use within the set of fuel injector assemblies 32 of FIGS. 2 and 3. The fuel injector 500 includes an outer wall 502 surrounding an injector passage 504 defining a longitudinal injector axis 506. A first supply of air (A1) can be provided axially along the injector passage 504, or can be swirled by an axial swirler, like that of the swirler assembly 124 of FIG. 4 in a non-limiting example. A swirler assembly 508 can be provided as a radial swirler with a set of radial air passages 510 in annular arrangement about the outer wall 502 that can provide a second supply of air (A2) radially to the injector passage 504 in crossflow with the first supply of air (A1). The set of radial air passages 510 can form a radial swirler. The set of radial air passages 510 can be offset from or unaligned with the longitudinal injector axis 506, such as tangentially relative to the outer wall 502, in order to impart a swirl to the second supply of air (A2) entering the injector passage 504 to define the swirler assembly 508. In a non-limiting example, the first supply of air (A1) can be provided from an axial swirler, and the second supply of air (A2) can be provided from a radial swirler defined by the set of radial air passages 510.

Utilizing the first supply of air (A1) and the second supply of air (A2) can create greater turbulence in the airflow prior to injection of a supply of fuel (F) from a set of fuel passages 514, which can facilitate intermixing and reduce emissions.

Figure 12:
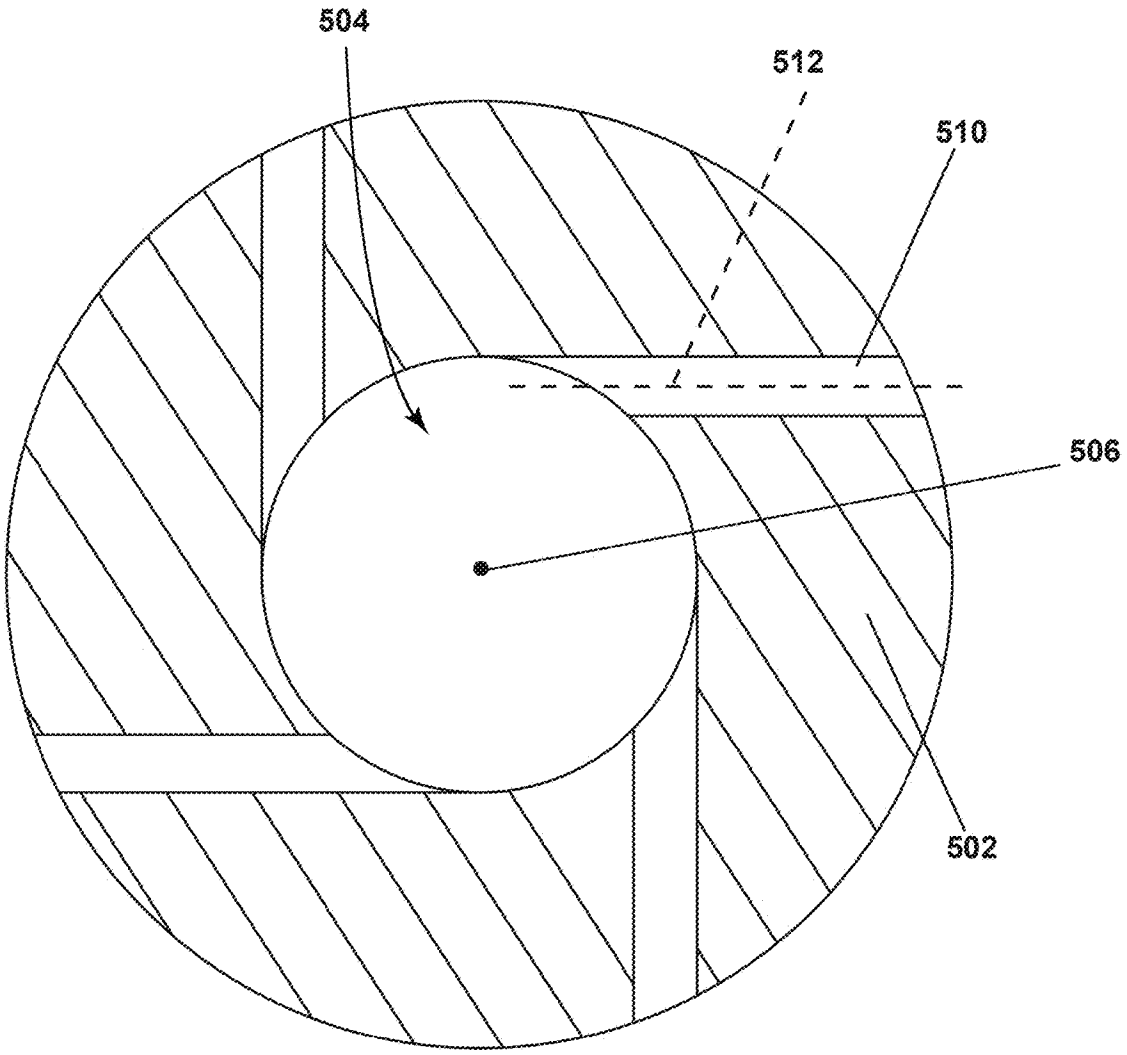
FIG. 12 is a schematic, cross-sectional view of the fuel injector of FIG. 11 taken along line XII-XII illustrating the arrangement of the set of radial air passages, in accordance with an aspect of the present disclosure.

FIG. 12 illustrates a schematic cross-sectional view of the fuel injector 500 of FIG. 11 taken along line XII-XII. The set of radial air passages 510 can have circular cross-sections, while any cross-sectional shape is within the scope of this disclosure. The set of radial air passages 510 can extend through the outer wall 502 in a manner unaligned with the longitudinal injector axis 506, while an aligned arrangement is contemplated. An unaligned arrangement is defined by a passage axis 512 that does not intersect the longitudinal injector axis 506 (shown as a dot in the sectioned view as the longitudinal injector axis 506 extends into and out of the page in FIG. 12). Such an unaligned arrangement can include a tangential alignment for the set of radial air passages 510, or their passage axes 512, such that the set of radial air passages 510 impart a swirl to the second supply of air (A2) as it enters the injector passage 504. In this way, the set of radial air passages 510 can act as a swirler to provide a swirling airflow as the second supply of air (A2), which moves aft due to the first supply of air (A1).

Figure 13:
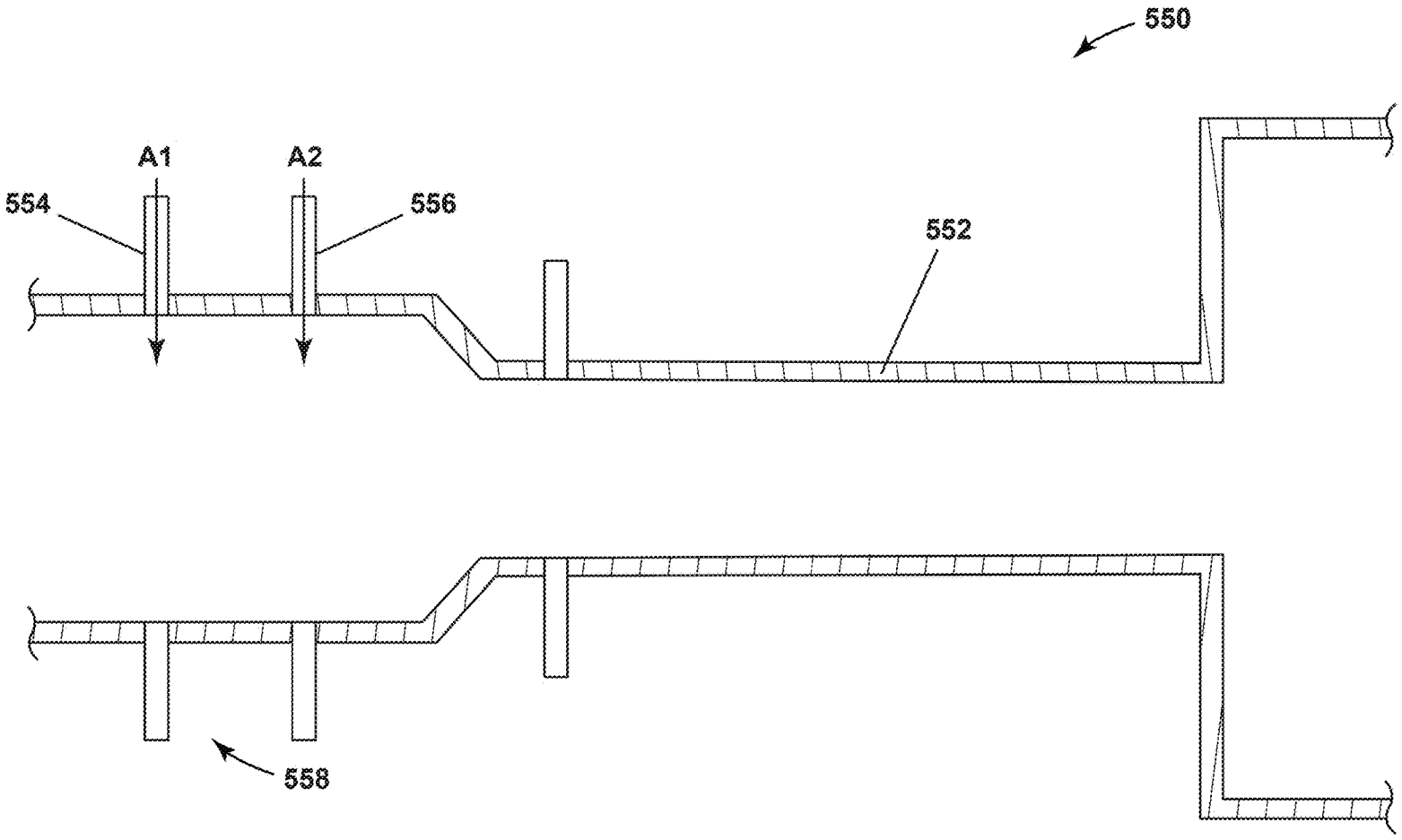
FIG. 13 is a schematic, cross-sectional view of a fuel injector for use within the set of fuel injectors of FIG. 3 and having first set of air passages and a second set of air passages in annular arrangement about the fuel injector, in accordance with an aspect of the present disclosure.

FIG. 13 illustrates a cross-sectional view of a fuel injector 550 suitable for use within the set of fuel injector assemblies 32 of FIGS. 2 and 3. The fuel injector 550 can be substantially similar to the fuel injector 500 of FIG. 11, and therefore, the discussion will be limited to differences between the two. More specifically, the fuel injector 550 of FIG. 13 includes a swirler assembly 558 as a radial swirler assembly that includes a first radial supply of air (A1) and a second radial supply of air (A2), while FIG. 11 includes a single annular arrangement of the set of radial air passages 510.

The fuel injector 550 includes an outer wall 552. The swirler assembly 558 includes a first set of air passages 554 extend through the outer wall 552 and a second set of air passages 556 extend through the outer wall 552 spaced aft of the first set of air passages 554. The first and second sets of air passages 554, 556 can provide the first and second supplies of air (A1), (A2) as co-swirling or counter swirling airflows with a tangential arrangement with respect to the outer wall 552. The first set of air passages 554 can be circumferentially aligned with the second set of air passages 556 about the outer wall 552, or may be offset, such as in a staggered arrangement, with the first and second sets of air passages 554, 556 being circumferentially unaligned with one another. Additionally, the first and second sets of air passages 554, 556 may be similar or different, such as having different angles of orientation, cross-sectional areas, number of flow passages, or combinations thereof, in non-limiting examples.

Figure 14:
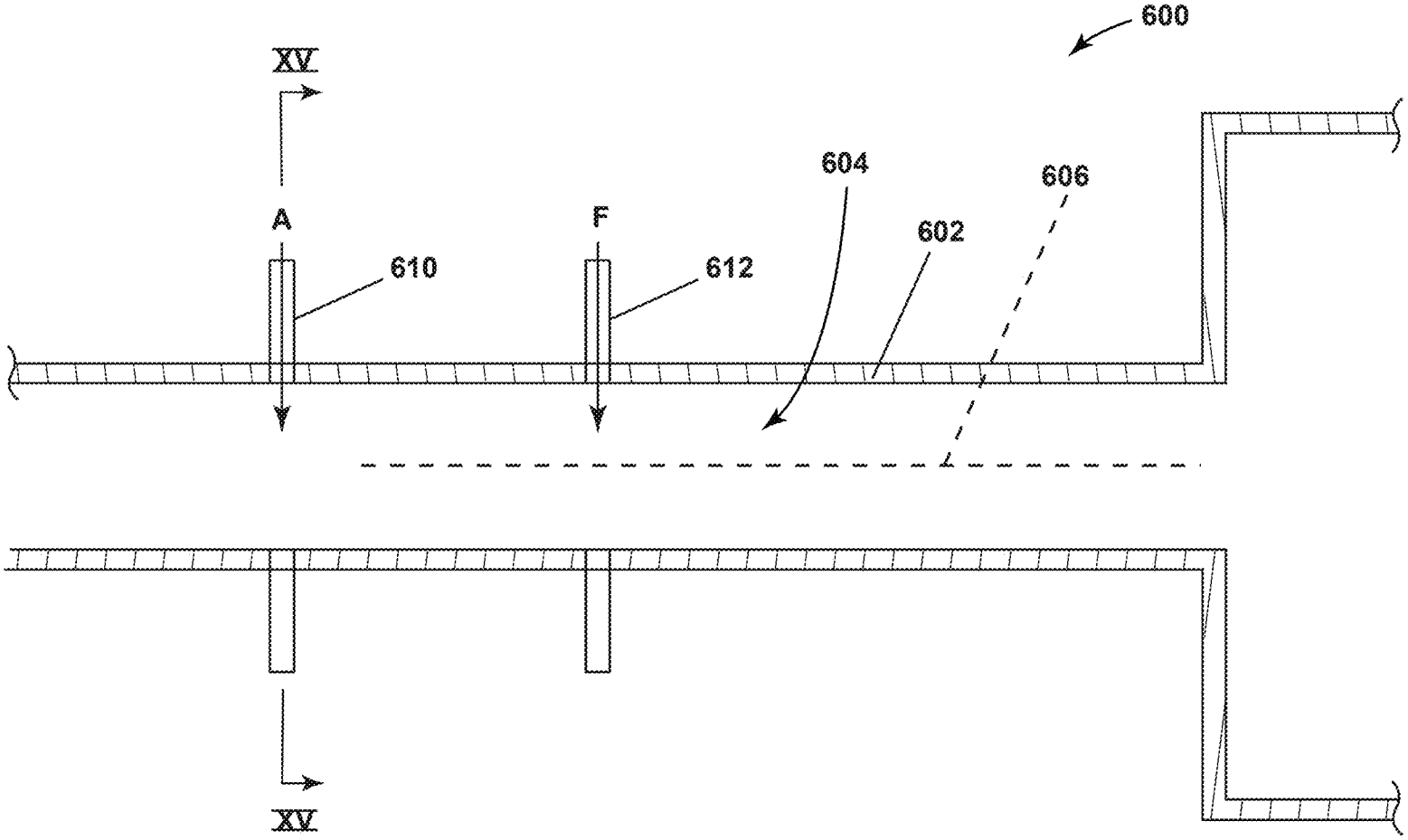
FIG. 14 is a schematic, cross-sectional view of a fuel injector for use within the set of fuel injectors of FIG. 3 and having no converging portion, in accordance with an aspect of the present disclosure.

FIG. 14 illustrates a cross-sectional view of a fuel injector 600 suitable for use within the set of fuel injector assemblies 32 of FIGS. 2 and 3. The fuel injector 600 includes an outer wall 602 surrounding an injector passage 604 and defining a longitudinal injector axis 606. The outer wall 602 defines a constant cross-sectional area for the injector passage 604. A swirler assembly 608, provided as a radial swirler, includes a set of air passages 610 are provided in annular arrangement about the outer wall 602 that can have a tangential arrangement with respect to the outer wall 602 to impart a swirl to a flow of air (A).A set of fuel passages 612 are provided in annular arrangement about the outer wall 602 downstream of the set of air passages 610, relative to a flow direction through the fuel injector 600.

Figure 15:
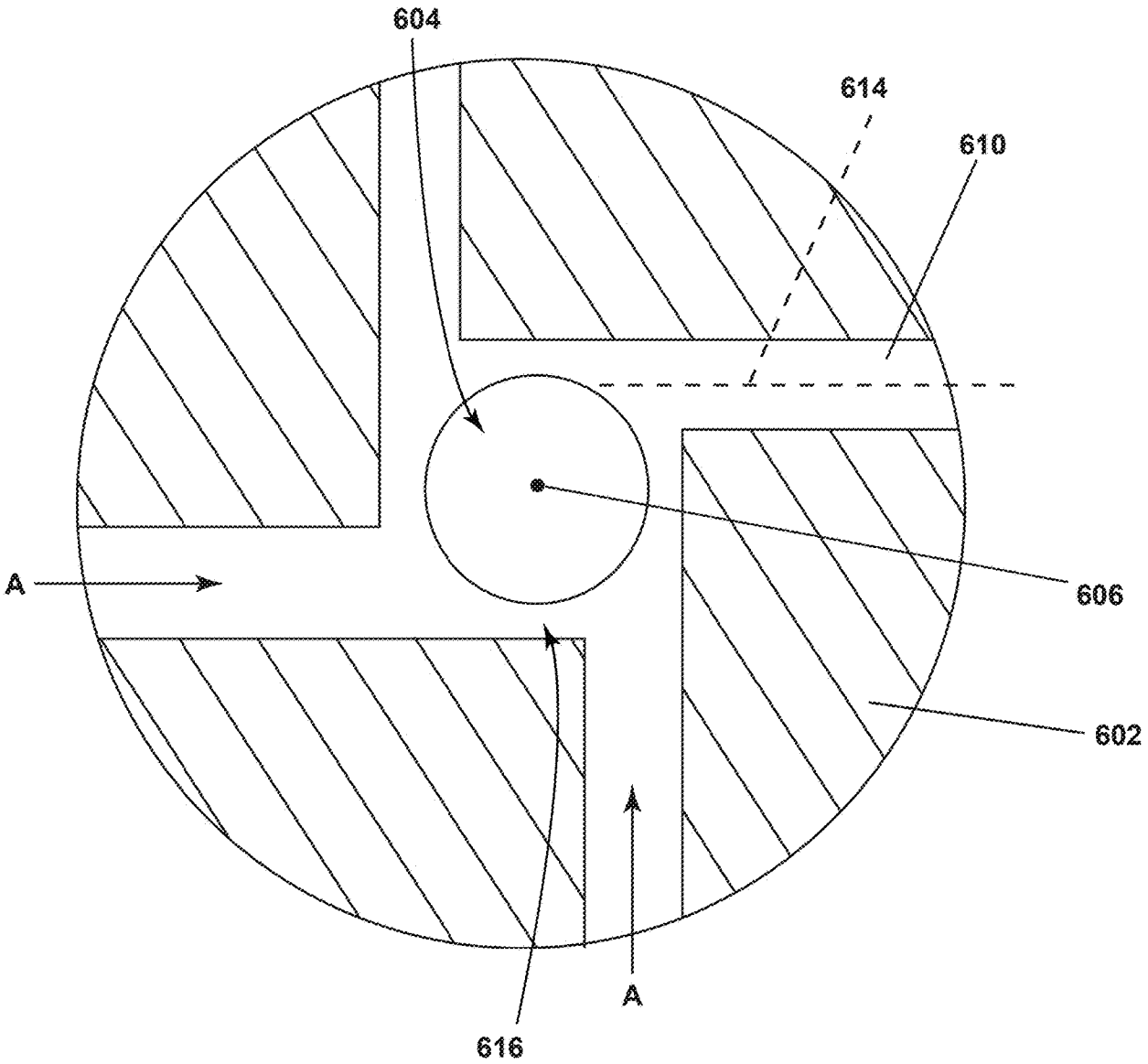
FIG. 15 is a schematic, cross-sectional view of the fuel injector of FIG. 14 taken along line XV-XV illustrating an air passage cavity for a set of air passages, in accordance with an aspect of the present disclosure.

FIG. 15 illustrates a cross-sectional view of the fuel injector 600 of FIG. 14 taken along line XV-XV of FIG. 14. The set of air passages 610 can have a circular cross-sectional shape, while any cross-sectional shape is contemplated. The set of air passages 610 can each define passages axes 614. The passage axes 614 are offset from the longitudinal injector axis 606 (extending into and out of the page in FIG. 15). Such an unalignment can impart a swirl to a flow of air (A) exhausting from the set of air passages 610 to the injector passage 604.

The set of air passages 610 intersect one another within the outer wall 602 to define an air passage cavity 616. That is, each of the set of air passages 610 are arranged such that a portion of each of the set of air passages 610 extends through the outer wall 602 to intersect at least one other air passage of the set of air passages 610. In a non-limiting example, it is contemplated that the air passage cavity 616 is circular in cross-section, such that the air passage cavity 616 has a diameter that is greater than that of the injector passage 604. In such an example, the set of air passages 610 can be arranged tangentially to the injector passage 604 to impart a swirl to the flow of air (A) exhausting from the set of air passages 610.

In operation, multiple flows of air (A) provided through the set of air passages 610 can at least partially merge within the air passage cavity 616 prior to entering the injector passage 604. The air passage cavity 616 permits an annular supply of air to enter the injector passage 604, which can provide greater consistency of application of air to the injector passage 604, as well as ensuring enough airflow is provided to the injector passage 604.

Benefits associated with the fuel injectors described herein include reductions in emissions, such as NOx emissions. Converging fuel passages provide relatively smaller tubes, which provide reductions in emissions due to reductions in flame length and low residence time for the flame front within the combustion chamber. Furthermore, relatively smaller tubes are more resistant to flashback resultant of lesser heat loss to the walls of the fuel injector. Furthermore, swirling the airflow provided from a swirler or tangentially arranged set of air passages increases kinetic energy within the fuel injector, which creates higher mixedness of fuel and air at the injector exit, thereby reducing emissions or permitting the use of hydrogen fuels to reduce emissions.

The fuel injectors described herein provide improved flame stability for the flame in the combustion chamber, permitting wider operability while mitigating flashback. Such benefits permit the reduction of emissions, like NOx emissions. The converging portions, reduce the diameter of the outer wall as it extends toward the combustion chamber which results in relatively smaller diameters for the injector outlet, which can generate a relatively reduced flame length and relatively reduced residence time within the flame front, thereby reducing the opportunity for occurrence of flashback due to relatively decreased heat loss to the adjacent wall structure. Contraction of diameter for the injector passage created by the converging portions discussed herein creates a high-turbulence wake which facilitates intermixing of the fuel and air.

Injection of the supply of fuel (F) at the second cylindrical portion provides injection of fuel to the flow of air (A) into a relatively low velocity region, relative to an increased velocity within downstream cylindrical portions, permitting greater penetration of the supply of fuel (F) into the flow of air (A), which facilitates intermixing among the fuel and air. A second converging portion can further increase velocity of the mixture of the supply of fuel (F) and the flow of air (A), which mitigates flashback. Additionally, injection of the supply of fuel (F) downstream of the provision of the flow of air (A) can mitigate flashback and flame holding. Provision of the fuel injection in a high velocity region, being relative to that of the lower-velocity regions having larger diameters, like the upstream cylindrical portions, mitigates flame holding within the injector passage.

Use of the swirler assembly increases kinetic energy within the flow of air (A), which increases intermixing of the flow of air (A) and the supply of fuel (F). The relatively larger diameter at the swirler assembly, relative to the smaller-diameter portions of the fuel injector downstream of the swirler, reduces aerodynamic losses associated with the swirler assembly, while the downstream reduction in diameter permits the smaller diameter at the injector outlet, which mitigates flashback. Additionally, such a larger diameter for the swirler assembly provides additional room to account for flow blockage created by the set of vanes, while appreciating the benefits of a swirling flow for the flow of air (A). Injection of the supply of fuel (F) to a downstream cylindrical portion having a reduced diameter injects the fuel into a relatively higher velocity region than that of at the swirler assembly, which reduces the occurrence of flame holding within the injector passage.

Additionally, the radial injection of the fuel into the swirling airflow can generate a larger fuel concentration along the exterior of the fuel passage, which can improve flame stability and reduce boundary layer flashback, while also reducing emissions or permitting the use of hydrogen fuels to reduce emissions.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

It will be appreciated that the fuel injectors, and aspects thereof, as discussed herein are provided by way of example only and that in other exemplary embodiments, the fuel injectors may have any other suitable configurations. The aspects and features provided herein need not be limited to the embodiments as shown, and it is further contemplated that features and aspects from one or more embodiments can be added, removed, or interchanged with one or more other embodiment to define additional embodiments herein. For example, the first and second converging portions 130, 132 can be incorporated into FIG. 5-8, 11, 13, or 14. In another example, the first and second sets of fuel passages 232, 234 of FIG. 6 can be incorporated into FIG. 4-5, 7-11, or 13-14. In this way, it should be understood that a myriad of combinations is possible, and that aspects and features discussed herein can be added, removed, interchanged, or intermixed to define these combinations.

It should be appreciated that the different fuel injectors and their features as described among FIGS. 4-15 can all be utilized within a common engine, such as the turbine engine 10 of FIG. 1, or within a common component, such as the combustor 34 of FIGS. 2-3, and it should be understood that the fuel injectors and their features are not mutually exclusive.

Further aspects are provided by the subject matter of the following clauses:

A fuel injector for a turbine engine comprising a compression section, a combustion section, and a turbine section in serial flow arrangement, the fuel injector comprising: an outer wall surrounding an injector passage and defining a longitudinal injector axis, the injector passage exhausting at an injector outlet and defining a flow direction through the injector passage; a first converging portion provided in the outer wall; a swirler assembly configured to provide a swirled airflow to the injector passage upstream of the first converging portion relative to the flow direction; and a first set of fuel passages in annular arrangement about the outer wall fluidly exhausting to the injector passage downstream of the first converging portion relative to the flow direction.

The fuel injector of any preceding clause, further comprising a second converging portion provided in the outer wall downstream of the first set of fuel passages relative to the flow direction.

The fuel injector of any preceding clause, wherein the swirler assembly includes an axial swirler.

The fuel injector of any preceding clause, further comprising a centerbody positioned within the injector passage at the swirler assembly, and wherein the swirler assembly further comprises a set of vanes extending between the centerbody and the outer wall.

The fuel injector of any preceding clause, wherein the axial swirler includes a radially inner swirler and a radially outer swirler positioned within the injector passage.

The fuel injector of any preceding clause, further comprising a second set of fuel passages in annular arrangement about the outer wall and positioned downstream of the first set of fuel passages relative to the flow direction.

The fuel injector of any preceding clause, wherein the first set of fuel passages are configured to operate at a high power level and the second set of fuel passages are configured to operate at a low power level lower than that of the high power level.

The fuel injector of any preceding clause, further comprising a set of turbulators extending from the outer wall into the injector passage in annular arrangement about the outer wall.

The fuel injector of any preceding clause, wherein the set of turbulators are provided upstream of the first set of fuel passages, relative to the flow direction.

The fuel injector of any preceding clause, further comprising a turbulator provided within and in annular arrangement about the injector passage.

The fuel injector of any preceding clause, wherein the set of turbulators are provided downstream of the first converging portion, relative to the flow direction.

The fuel injector of any preceding clause, further comprising an annular body positioned within the injector passage along the outer wall.

The fuel injector of any preceding clause, further comprising a set of flow passages extending through the annular body.

The fuel injector of any preceding clause, wherein the annular body includes a forward surface and a side surface, and wherein the set of flow passages include an inlet on the forward surface and an outlet in the side surface.

The fuel injector of any preceding clause, wherein the annular body is positioned immediately upstream of the set of fuel passages.

The fuel injector of any preceding clause, wherein the set of flow passages are circumferentially offset from the first set of fuel passages.

The fuel injector of any preceding clause, wherein the outer wall further comprises a second converging portion extending from the first converging portion in the flow direction, wherein the first converging portion converges at a different rate than that of the second converging portion.

The fuel injector of any preceding clause, wherein the second converging portion converges at a greater rate than the first converging portion.

The fuel injector of any preceding clause, wherein the outer wall further comprises a first cylindrical portion and a second cylindrical portion, and wherein the first converging portion is positioned between the first cylindrical portion and the second cylindrical portion.

The fuel injector of any preceding clause, wherein the first set of fuel passages are arranged in the second cylindrical portion.

The fuel injector of any preceding clause, wherein the outer wall further comprises a third cylindrical portion and a second converging portion is positioned between the second cylindrical portion and the third cylindrical portion.

The fuel injector of any preceding clause, wherein the swirler assembly is a radial swirler.

The fuel injector of any preceding clause, wherein the radial swirler comprises a first set of air passages in annular arrangement about the outer wall.

The fuel injector of any preceding clause, wherein the first set of air passages are unaligned with the longitudinal injector axis to impart a swirl to an airflow exhausting from the first set of air passages into the injector passage.

The fuel injector of any preceding clause, wherein the radial swirler comprises a second set of air passages in annular arrangement about the outer wall and spaced from the first set of air passages.

The fuel injector of any preceding clause, wherein the first set of air passages are circumferentially offset from the second set of air passages.

The fuel injector of any preceding clause, wherein the first set of air passages partially intersect one another within the outer wall.

The fuel injector of any preceding clause, wherein the first set of air passages define an air passage cavity within the outer wall.

The fuel injector of any preceding clause, wherein the swirler assembly includes an axial swirler provided within the injector passage and a radial swirler provided as a set of air passages in annular arrangement about the outer wall.

A turbine engine comprising the fuel injector of any preceding clause.

A turbine engine including a compression section, a combustion section, and a turbine section in serial flow arrangement, the turbine engine comprising: a fuel injector provided in the combustion section, the fuel injector comprising: an outer wall surrounding an injector passage and defining a longitudinal injector axis, the injector passage exhausting at an injector outlet and defining a flow direction through the injector passage; a first converging portion provided in the outer wall; a swirler assembly configured to provide a swirled airflow to the injector passage upstream of the first converging portion relative to the flow direction; and a first set of fuel passages in annular arrangement about the outer wall fluidly exhausting to the injector passage downstream of the first converging portion relative to the flow direction.

The turbine engine of any preceding clause, further comprising a second converging portion provided in the outer wall downstream of the first set of fuel passages relative to the flow direction.

The turbine engine of any preceding clause, wherein the swirler assembly includes an axial swirler.

The turbine engine of any preceding clause, further comprising a centerbody positioned within the injector passage at the swirler assembly, and wherein the swirler assembly further comprises a set of vanes extending between the centerbody and the outer wall.

The turbine engine of any preceding clause, wherein the axial swirler includes a radially inner swirler and a radially outer swirler positioned within the injector passage.

The turbine engine of any preceding clause, further comprising a second set of fuel passages in annular arrangement about the outer wall and positioned downstream of the first set of fuel passages relative to the flow direction.

The turbine engine of any preceding clause, wherein the first set of fuel passages are configured to operate at a high power level and the second set of fuel passages are configured to operate at a low power level lower than that of the high power level.

The turbine engine of any preceding clause, further comprising a set of turbulators extending from the outer wall into the injector passage in annular arrangement about the outer wall.

The turbine engine of any preceding clause, wherein the set of turbulators are provided upstream of the first set of fuel passages, relative to the flow direction.

The turbine engine of any preceding clause, further comprising a turbulator provided within and in annular arrangement about the injector passage.

The turbine engine of any preceding clause, wherein the set of turbulators are provided downstream of the first converging portion, relative to the flow direction.

The turbine engine of any preceding clause, further comprising an annular body positioned within the injector passage along the outer wall.

The turbine engine of any preceding clause, further comprising a set of flow passages extending through the annular body.

The turbine engine of any preceding clause, wherein the annular body includes a forward surface and a side surface, and wherein the set of flow passages include an inlet on the forward surface and an outlet in the side surface.

The turbine engine of any preceding clause, wherein the annular body is positioned immediately upstream of the set of fuel passages.

The turbine engine of any preceding clause, wherein the set of flow passages are circumferentially offset from the first set of fuel passages.

The turbine engine of any preceding clause, wherein the outer wall further comprises a second converging portion extending from the first converging portion in the flow direction, wherein the first converging portion converges at a different rate than that of the second converging portion.

The turbine engine of any preceding clause, wherein the second converging portion converges at a greater rate than the first converging portion.

The turbine engine of any preceding clause, wherein the outer wall further comprises a first cylindrical portion and a second cylindrical portion, and wherein the first converging portion is positioned between the first cylindrical portion and the second cylindrical portion.

The turbine engine of any preceding clause, wherein the first set of fuel passages are arranged in the second cylindrical portion.

The turbine engine of any preceding clause, wherein the outer wall further comprises a third cylindrical portion and a second converging portion is positioned between the second cylindrical portion and the third cylindrical portion.

The turbine engine of any preceding clause, wherein the swirler assembly is a radial swirler.

The turbine engine of any preceding clause, wherein the radial swirler comprises a first set of air passages in annular arrangement about the outer wall.

The turbine engine of any preceding clause, wherein the first set of air passages are unaligned with the longitudinal injector axis to impart a swirl to an airflow exhausting from the first set of air passages into the injector passage.

The turbine engine of any preceding clause, wherein the radial swirler comprises a second set of air passages in annular arrangement about the outer wall and spaced from the first set of air passages.

The turbine engine of any preceding clause, wherein the first set of air passages are circumferentially offset from the second set of air passages.

The turbine engine of any preceding clause, wherein the first set of air passages partially intersect one another within the outer wall.

The turbine engine of any preceding clause, wherein the first set of air passages define an air passage cavity within the outer wall.

The turbine engine of any preceding clause, wherein the swirler assembly includes an axial swirler provided within the injector passage and a radial swirler provided as a set of air passages in annular arrangement about the outer wall.

What is claimed is:

1. A fuel injector for a gas turbine engine comprising a compression section, a combustion section, and a turbine section in serial flow arrangement, the fuel injector comprising:

an outer wall surrounding an injector passage and defining a longitudinal injector axis, the injector passage exhausting at an injector outlet and defining a flow direction through the injector passage;

a first converging portion provided in the outer wall;

a first set of fuel passages in annular arrangement about the outer wall fluidly exhausting to the injector passage downstream of the first converging portion relative to the flow direction;

a second set of fuel passages in annular arrangement about the outer wall and positioned downstream of the first set of fuel passages relative to the flow direction;

a second converging portion provided in the outer wall downstream of the first set of fuel passages relative to the flow direction; and a swirler assembly configured to provide a swirled airflow to the injector passage upstream of the first converging portion relative to the flow direction.

2. The fuel injector of claim 1, wherein the swirler assembly includes an axial swirler.

3. The fuel injector of claim 2, further comprising a centerbody positioned within the injector passage at the swirler assembly, and wherein the swirler assembly further comprises a set of vanes extending between the centerbody and the outer wall.

4. The fuel injector of claim 1, further comprising a set of turbulators extending from the outer wall into the injector passage in annular arrangement about the outer wall.

5. The fuel injector of claim 4, wherein the set of turbulators are provided upstream of the first set of fuel passages and downstream of the first converging portion, relative to the flow direction.

6. The fuel injector of claim 1, wherein the outer wall further comprises a first cylindrical portion and a second cylindrical portion, and wherein the first converging portion is positioned between the first cylindrical portion and the second cylindrical portion.

7. The fuel injector of claim 6, wherein the first set of fuel passages are arranged in the second cylindrical portion.

8. The fuel injector of claim 7, wherein the outer wall further comprises a third cylindrical portion and the second converging portion is positioned between the second cylindrical portion and the third cylindrical portion.

9. A fuel injector for a gas turbine engine comprising a compression section, a combustion section, and a turbine section in serial flow arrangement, the fuel injector comprising:

an outer wall surrounding an injector passage and defining a longitudinal injector axis, the injector passage exhausting at an injector outlet and defining a flow direction through the injector passage;

a first converging portion provided in the outer wall;

a swirler assembly configured to provide a swirled airflow to the injector passage upstream of the first converging portion relative to the flow direction;

a first set of fuel passages in annular arrangement about the outer wall fluidly exhausting to the injector passage downstream of the first converging portion relative to the flow direction; and a second set of fuel passages in annular arrangement about the outer wall and positioned downstream of the first set of fuel passages relative to the flow direction.

10. A fuel injector for a gas turbine engine comprising a compression section, a combustion section, and a turbine section in serial flow arrangement, the fuel injector comprising:

an outer wall surrounding an injector passage and defining a longitudinal injector axis, the injector passage exhausting at an injector outlet and defining a flow direction through the injector passage;

a first converging portion provided in the outer wall;

a second converging portion extending from the first converging portion in the flow direction, and wherein the first converging portion converges at a different rate than that of the second converging portion;

a swirler assembly configured to provide a swirled airflow to the injector passage upstream of the first converging portion relative to the flow direction; and a first set of fuel passages in annular arrangement about the outer wall fluidly exhausting to the injector passage downstream of the first converging portion relative to the flow direction.

11. The fuel injector of claim 10, further comprising an annular body positioned within the injector passage along the outer wall.

12. The fuel injector of claim 11, further comprising a set of flow passages extending through the annular body.

13. The fuel injector of claim 12, wherein the annular body includes a forward surface and a side surface, and wherein the set of flow passages include an inlet on the forward surface and an outlet in the side surface.

14. A fuel injector for a gas turbine engine comprising a compression section, a combustion section, and a turbine section in serial flow arrangement, the fuel injector comprising:

an outer wall surrounding an injector passage and defining a longitudinal injector axis, the injector passage exhausting at an injector outlet and defining a flow direction through the injector passage;

a first converging portion provided in the outer wall;

a swirler assembly configured to provide a swirled airflow to the injector passage upstream of the first converging portion relative to the flow direction, wherein the swirler assembly is a radial swirler and comprises a first set of air passages in annular arrangement about the outer wall;

a first set of fuel passages in annular arrangement about the outer wall fluidly exhausting to the injector passage downstream of the first converging portion relative to the flow direction; and a second set of fuel passages in annular arrangement about the outer wall and positioned downstream of the first set of fuel passages relative to the flow direction.

15. The fuel injector of claim 14, wherein the first set of air passages are unaligned with the longitudinal injector axis to impart a swirl to an airflow exhausting from the first set of air passages into the injector passage.

16. The fuel injector of claim 14, wherein the first set of air passages partially intersect one another within the outer wall.

17. The fuel injector of claim 14, wherein the radial swirler comprises a second set of air passages in annular arrangement about the outer wall and spaced from the first set of air passages.

18. The fuel injector of claim 14, wherein the first set of air passages define an air passage cavity within the outer wall.

19. A fuel injector for a gas turbine engine comprising a compression section, a combustion section, and a turbine section in serial flow arrangement, the fuel injector comprising:

an outer wall surrounding an injector passage and defining a longitudinal injector axis, the injector passage exhausting at an injector outlet and defining a flow direction through the injector passage;

a first converging portion provided in the outer wall;

a swirler assembly configured to provide a swirled airflow to the injector passage upstream of the first converging portion relative to the flow direction wherein the swirler assembly includes an axial swirler provided within the injector passage and a radial swirler provided as a set of air passages in annular arrangement about the outer wall; and a first set of fuel passages in annular arrangement about the outer wall fluidly exhausting to the injector passage downstream of the first converging portion relative to the flow direction.

* * * * *